US011505961B2

(12) United States Patent
Huang

(10) Patent No.: US 11,505,961 B2
(45) Date of Patent: Nov. 22, 2022

(54) SINGLE-ROW MULTILAYER STORAGE WAREHOUSE SYSTEM WITH VERTICAL AVOIDANCE

(71) Applicant: Caixiong Huang, Nanning (CN)

(72) Inventor: Caixiong Huang, Nanning (CN)

( * ) Notice: Subject to any disclaimer, the term of this patent is extended or adjusted under 35 U.S.C. 154(b) by 0 days.

(21) Appl. No.: 17/580,680

(22) Filed: Jan. 21, 2022

(65) Prior Publication Data

US 2022/0136272 A1 May 5, 2022

Related U.S. Application Data

(63) Continuation of application No. PCT/CN2020/114081, filed on Sep. 8, 2020.

(30) Foreign Application Priority Data

Sep. 9, 2019 (CN) ..... 201910889860.8
Oct. 10, 2019 (CN) ..... 201911004575.X

(51) Int. Cl.
*E04H 6/18* (2006.01)
*E04H 6/24* (2006.01)
*E04H 6/42* (2006.01)

(52) U.S. Cl.
CPC ..... *E04H 6/185* (2013.01); *E04H 6/24* (2013.01); *E04H 6/422* (2013.01)

(58) Field of Classification Search
CPC .. E04H 6/18; E04H 6/185; E04H 6/24; E04H 6/42; E04H 6/422; E04H 6/22; E04H 6/12; E04H 6/424
See application file for complete search history.

(56) References Cited

U.S. PATENT DOCUMENTS 5,678,972 A * 10/1997 Bockler ..... E04H 6/422 414/234
5,707,199 A * 1/1998 Faller ..... B65G 1/0478 414/21
8,166,101 B2 4/2012 Shah
(Continued)

FOREIGN PATENT DOCUMENTS

CN 106836904 A 6/2017
CN 206554576 U 10/2017
(Continued)

*Primary Examiner* — Mark C Hageman
(74) *Attorney, Agent, or Firm* — True Shepherd LLC; Andrew C. Cheng

(57) ABSTRACT

A single-row multilayer storage warehouse system comprises a plurality of storage layers, a plurality of storage warehouse lifting apparatus, shafts arranged at both ends and/or in the middle of the storage warehouse system, a plurality of supporting mechanisms, a supporting mechanism lifting apparatus and a plurality of self-delivering trolleys. Each storage layer is provided with a plurality of storage shelf groups arranged symmetrically side by side; each storage shelf comprises a first supporting component for storing goods and a first rail; the first supporting component is arranged at the lower part of the storage shelf; the first rail is arranged at the upper part of the storage shelf; the self-delivering trolleys is capable of running between the rails of the storage shelves on the lower layer and the bottom of the first supporting component of the storage shelves on the layer.

11 Claims, 33 Drawing Sheets

(56) References Cited

U.S. PATENT DOCUMENTS

| | | | | |
|---|---|---|---|---|
| 10,405,395 | B2 | 9/2019 | Aykroyd | |
| 10,883,289 | B2 * | 1/2021 | Lin | E04H 6/22 |
| 11,142,476 | B2 | 10/2021 | Baker | |

FOREIGN PATENT DOCUMENTS

| | | | |
|---|---|---|---|
| CN | 107338988 | A | 11/2017 |
| CN | 206785033 | U | 12/2017 |
| CN | 107859399 | A | 3/2018 |
| CN | 108071250 | A | 5/2018 |

* cited by examiner

SINGLE-ROW MULTILAYER STORAGE WAREHOUSE SYSTEM WITH VERTICAL AVOIDANCE

CROSS-REFERENCE TO RELATED APPLICATIONS

This application is a continuation of International Patent Application No. PCT/CN2020/114081 with a filing date of Sep. 8, 2020, designating the United States, and further claims priority to Chinese Patent Application No. 201910889860.8 with a filing date of Sep. 9, 2019 and Chinese Patent Application No. 201911004575.X with a filing date of Oct. 10, 2019. The content of the aforementioned applications, including any intervening amendments thereto, are incorporated herein by reference.

TECHNICAL FIELD

The present disclosure relates to the technical field of accessing of goods, and particularly relates to a single-row multilayer storage warehouse system with vertical avoidance.

BACKGROUND OF THE PRESENT INVENTION

With the development of society and the improvement of people's living standards, cars have entered ordinary families, and the problem of parking difficulty has gradually become a social problem, which is mainly reflected in the shortage of parking spaces and the too long time of storage and pick-up of vehicles. People expect to park more vehicles on the limited land area and shorten the time of storage and pick-up of the vehicles.

A Chinese patent application with the publication No. CN211115051U discloses a novel vertical lifting three-dimensional garage, which comprises a parking area, an entrance and exit area, a working well area, a mechanical equipment system and an automatic control system. The parking area is provided with a plurality of parking layers, and parking spaces are arranged on the parking layers; one side or multiple sides of the working well area are adjacent to the parking area; the mechanical equipment system comprises a lifting platform, and the lifting platform is located in the working well area and can vertically ascend and descend to the designated parking layer in the working well area; the lifting platform is provided with transverse movement guide rails, and no less than two carrying trolleys are arranged on the transverse movement guide rails, and the carrying trolleys can transversely and horizontally move to the designated parking spaces on the lifting platform; and each carrying trolley is provided with a carrier which can move horizontally along the direction perpendicular to the transverse movement guide rails. The three-dimensional garage is provided with the entrance and exit area; if a lot of vehicles need to be stored and picked up in a short time, a plurality of entrance and exit areas need to be arranged, which will take up a lot of space; if many vehicles need to be stored and picked up in a short time, the difficulty in vehicle scheduling is increased; and if the vehicle scheduling is not handled properly, the efficiency of storage and pick-up of the vehicles is reduced.

The technology of storage and pick-up of containers at port wharfs is also similar to the technology of storage and pick-up of the vehicles. With the rapid development of maritime trade between China and other countries in the world, the importance of construction of the port wharfs is highlighted. As the time for ships to dock for loading and unloading the containers is limited, and the space for storing the containers at the port wharfs is also limited, the technology of loading, unloading, storage and pick-up of the containers should be developed towards less floor space, more energy saving, more environmental protection, more labor saving and high efficiency.

Therefore, it is urgent to develop a storage warehouse system with small floor space, more labor saving and high efficiency.

SUMMARY OF PRESENT INVENTION

The technical purpose of the present disclosure is to provide a single-row multilayer storage warehouse system with vertical avoidance, which has small floor space, more labor saving and high efficiency, so as to solve the above defects in the prior art.

Vertical avoidance refers to that when goods need to move to be stored or picked up, the goods are avoided by other goods that are located on the same layer and block the front of the movement direction of the goods in a manner of moving upwards along the vertical direction, so that the goods can horizontally move on the same layer.

As one aspect of the present disclosure, the present disclosure provides the single-row multilayer storage warehouse system with vertical avoidance; and the storage warehouse system comprises a plurality of storage layers, a plurality of storage shelf lifting apparatus, shafts arranged at both ends and/or in the middle of the storage warehouse system, a plurality of supporting mechanisms, a supporting mechanism lifting apparatus and a plurality of self-delivering trolleys;

Each storage layer is provided with a plurality of storage shelf groups that are arranged side by side; each storage shelf comprises a first supporting component for storage of goods, a first rail for running of the self-delivering trolleys and a guide post for enabling the storage shelf to move vertically; the storage shelves are rigid bodies; the storage shelves are symmetrically arranged to form the storage shelf groups; the first supporting component is arranged at the lower part of each of the storage shelves; the first rail is arranged at the top of each of the storage shelves, except the storage shelf on the uppermost layer; a fourth fixed rail is arranged at the lower part of the storage layer on the lowermost layer; the self-delivering trolleys is capable of running on the first rail on the multiple storage shelves or the fourth fixed rail; each storage shelf group is in a cuboid structure; each storage shelf group corresponds to four guide posts, and the four guide posts are respectively and vertically fixed on four vertical edges of the storage shelf group; the length of each guide post is equal to the height of each storage layer; the storage shelves are directly stacked one by one from bottom to top; and the storage shelf lifting apparatus are configured to enable the storage shelf groups to move up and down along the vertical direction;

Each supporting mechanism lifting apparatus is configured to enable the supporting mechanism to move up and down in the shaft and enable the supporting mechanism to stay on each storage layer; and when the supporting mechanism stays on the storage layer, the self-delivering trolley on the same layer is capable of running onto the supporting mechanism and of moving up and down along with the supporting mechanism;

Each self-delivering trolley comprises a main frame, first running wheels located on both sides of the main frame, a second supporting component arranged above the main frame and a goods lifting mechanism for enabling the second supporting component to move up and down; the highest point which the second supporting component ascends to is higher than the first supporting component of the storage shelves; the lowest point which the second supporting component descends to is lower than the first supporting component of the storage shelves; and when the self-delivering trolley is located right under the storage shelves, the position of the second supporting component is staggered with the position of the first supporting component.

According to one exemplary implementation manner of the present disclosure, the self-delivering trolley (the second supporting component descends) can pass through between the rails of the storage shelf groups on the lower layer and the bottom of the first supporting component of the storage shelves on the layer; the bottom of the second supporting component of the self-delivering trolley (after the second supporting component and loaded goods ascend) is higher than the first supporting component; a safety passing distance is left between the top of the loaded goods and the bottom of the first supporting component on the upper layer; and the self-delivering trolley is capable of running between the storage shelves on the layer.

According to one exemplary implementation manner of the present disclosure, each self-delivering trolley also comprises a rechargeable battery pack.

According to one exemplary implementation manner of the present disclosure, guide rails which are parallel to the first rail are arranged above each supporting mechanism, so that when the supporting mechanism stays on each storage layer, the guide rails are connected with the first rail or the fourth fixed rail on the layer to form a continuous rail by a third supplementary rail arranged on first joining beams or fifth supplementary rails arranged on second joining beams; the self-delivering trolley is capable of running between the guide rails and the first rail or the fourth fixed rail on the same layer; and the first joining beams and the second joining beams are horizontally arranged between two first steel upright columns of the storage shelf lifting apparatus.

According to one exemplary implementation manner of the present disclosure, first calibrating and positioning devices are arranged on each supporting mechanism; second calibrating and positioning devices are arranged on the first rail; and third calibrating and positioning devices corresponding to the first calibrating and positioning devices and the second calibrating and positioning devices are arranged on each self-delivering trolley.

According to one exemplary implementation manner of the present disclosure, each first calibrating and positioning device comprises a first positioning hole; each second calibrating and positioning device comprises a second positioning hole; each third calibrating and positioning device comprises a second push rod arranged vertically and a second telescopic tongue fixed at the lower end of the second push rod; and the second telescopic tongue can be inserted into the first positioning hole or the second positioning hole.

According to one exemplary implementation manner of the present disclosure, the lower end of the second telescopic tongue is in a cone shape (which has the effect of forcible calibration).

According to one exemplary implementation manner of the present disclosure, the first supporting component is in a symmetrical structure.

The storage warehouse system of the present disclosure can be arranged on the ground and can also be arranged underground. When the goods are stored, the goods are transported to the position above the supporting mechanism of the self-delivering trolley and placed on the second supporting component; the supporting mechanism is used for transporting the goods to the designated storage layer; the second supporting component of the self-delivering trolley ascends to be higher than the first supporting component on the layer; the self-delivering trolley runs from the guide rails onto all the first rail or all the fourth fixed rail on the same layer through the supplementary rails on the first joining beams and the second joining beams and is used for transporting the goods to the designated storage shelf group along the first rail or the fourth fixed rail; the second supporting component descends to enable the goods to be placed on the first supporting component; and the second supporting component descends to be lower than the first supporting component, so as to complete the storage of the goods. If other goods are stored on the storage shelves in front of the goods, the storage shelf lifting apparatus is configured to lift the storage shelf group and all storage shelf groups above the storage shelf group upwards one-layer height for avoidance. When the goods are picked up, the self-delivering trolley runs to the position under the storage shelves, on which the goods are located, the second supporting component ascends to be higher than the first supporting component of the storage shelves, and the goods are placed on the second supporting component; the self-delivering trolley runs onto the guide rails of the supporting mechanism through the supplementary rails on the first joining beams and the second joining beams, and the supporting mechanism moves up and down along the vertical direction to an exit; and if other goods are stored on the storage shelf group in front of the goods, the storage shelf lifting apparatus is configured to lift the storage shelf group and all storage shelf groups above the storage shelf group upwards for avoidance.

According to one exemplary implementation manner of the present disclosure, the storage warehouse also comprises forcible indirect precise leveling sub-systems; and each forcible indirect precise leveling sub-system comprises a forcible leveling device, a forcible leveling jacket, an adjusting device and a forcible leveling female seat;

The forcible leveling devices are horizontally arranged on the side surfaces of each supporting mechanism; each forcible leveling device comprises two first telescopic tongues, two first synchronous racks, a first synchronous gear and a first push rod which is telescopic in the horizontal direction; the first telescopic tongues are fixed at both ends of the first push rod and are capable of stretching out and drawing back along with the first push rod; one end of each first synchronous rack is fixedly connected with one of the first telescopic tongues; and the other ends of the first synchronous racks are meshed with the first synchronous gear;

The forcible leveling jackets are rigidly connected with each supporting mechanism; each forcible leveling device is sleeved in each forcible leveling device jacket and can only move and swing up and down within a small scope under the constraint of the forcible leveling device jacket; each adjusting device is arranged at the bottom of each forcible leveling jacket and comprises a supporting spring and an adjusting bolt; and the adjusting device is used for enabling the forcible leveling device to approximately (precision is not needed.) suspend in the center of the forcible leveling jacket (in the vertical direction);

The forcible leveling female seats are arranged on each layer of the shafts; each forcible leveling female seat is internally provided with a position sensor corresponding to the first telescopic tongues; and a trumpet opening for receiving the first telescopic tongues is formed in the forcible leveling female seat.

According to one exemplary implementation manner of the present disclosure, each storage shelf lifting apparatus is configured to drive all storage shelves in the same vertical direction to move up and down.

According to one exemplary implementation manner of the present disclosure, each storage shelf lifting apparatus comprises four first steel upright columns, four lifting rods and a first power mechanism;

The first steel upright columns are arranged vertically; and a guide groove is formed in each first steel upright column, so that the four guide posts respectively slide up and down in the guide grooves of the four first steel upright columns;

The guide post is in a hollow structure; each lifting rod vertically penetrates through the interior of all the guide posts on the same first steel upright column; the upper part of each lifting rod is connected with the first power mechanism; the lower part of each lifting rod comprises a plurality of lifting hook sections; and each lifting hook section corresponds to one guide post; and Lifting bayonets are symmetrically formed in the side surfaces of each guide post; each lifting hook section is provided with lifting hooks at positions corresponding to the lifting bayonets; the lifting hooks is capable of stretching outwards or being opened and to couple with the lifting bayonets; and the lifting hooks is also capable of drawing back inwards.

According to one exemplary implementation manner of the present disclosure, the length of each guide post is the same as the height of each storage layer.

According to one exemplary implementation manner of the present disclosure, a rigid supporting seat is arranged at the bottom of each first steel upright column, and the rigid supporting seats are used for supporting the guide post of the storage shelves on the lowermost layer.

According to one exemplary implementation manner of the present disclosure, each lifting hook is in a V-shaped structure and comprises two hook arms, a first pin which is fixed and is used for connecting the two hook arms, and a torsional spring arranged at the connecting position of the two hook arms;

Each lifting hook section also comprises a telescopic sleeve and a third push rod; the third push rod is fixedly connected with the telescopic sleeve and is telescopic in the vertical direction; the telescopic sleeve is in a hollow tubular structure; the connecting position of the two hook arms is arranged at the upper part of the telescopic sleeve; and the telescopic sleeve can move up and down along with the third push rod, and the two hook arms are sleeved in or released out of the telescopic sleeve.

According to one exemplary implementation manner of the present disclosure, each lifting rod also comprises a drag chain; a power and control signal cable is connected into the lifting rod from the upper part of the lifting rod by the drag chain; and the power and control signal cable is connected with the lifting hook sections and is used for providing a control signal, controlling opening and closing of each lifting hook and feeding back a position signal to the system.

According to one exemplary implementation manner of the present disclosure, each storage shelf lifting apparatus also comprises a synchronization mechanism; the synchronization mechanism comprises a plurality of second synchronous racks fixed vertically at the upper parts of the lifting rods, two longitudinal synchronous shafts arranged horizontally, a plurality of second synchronous gears arranged at both ends of the longitudinal synchronous shafts, a plurality of third synchronous gears arranged in the middle of the longitudinal synchronous shafts, a transverse synchronous shaft arranged horizontally and a plurality of fourth synchronous gears arranged at both ends of the transverse synchronous shaft; both ends of each longitudinal synchronous shaft are meshed with the second synchronous racks by the second synchronous gears; the transverse synchronous shaft is perpendicular to the longitudinal synchronous shafts; and the third synchronous gears are meshed with the fourth synchronous gears.

According to one exemplary implementation manner of the present disclosure, each storage shelf lifting apparatus also comprises fall prevention mechanisms; each fall prevention mechanism comprises a fall prevention non-return rack fixed vertically at the upper part of each lifting rod and a decompression fall-prevention device fixed on the first steel upright column; the decompression fall-prevention device comprises a non-return tongue, a DC (Direction Current) coil body and a torsional spring; one end of the non-return tongue is articulated with a magnet core body of the DC coil body, and the other end of the non-return tongue is vertically hinged with the torsional spring; and the non-return tongue is capable of rotating along the axial direction of the torsional spring, so that the non-return tongue is clamped with or separated from the fall prevention non-return rack.

According to one exemplary implementation manner of the present disclosure, the number of the shafts is two, and the two shafts are respectively arranged at both ends of the storage warehouse system.

According to one exemplary implementation manner of the present disclosure, each supporting mechanism lifting apparatus comprises a plurality of vertical racks, a plurality of vertical guide rails, a plurality of trolley conductors, a plurality of movement gears meshed with the vertical racks, a first motor, a plurality of guide shoes, a plurality of electricity collection clips, a plurality of fourth push rods which are telescopic and arranged horizontally, and a plurality of third synchronous racks;

Each shaft comprises second steel upright columns for supporting the supporting mechanism to move up and down, and the vertical racks, the vertical guide rails and the trolley conductors are all vertically fixed on the second steel upright columns of the shaft;

The movement gears, the motor, the guide shoes, the electricity collection clips, the fourth push rods and the third synchronous racks are all arranged on the supporting mechanism;

The first motor is used for providing power of rotation for the movement gears and driving the supporting mechanism to move up and down; the guide shoes are fixed at both ends of each fourth push rod; the guide shoes are matched with the vertical guide rails when the guide shoes stretch out along with the fourth push rod, so that the supporting mechanism can move up and down along the vertical guide rails; and the electricity collection clips are also fixed at both ends of the fourth push rod, and the electricity collection clips are in touch with the trolley conductors to obtain electricity when the electricity collection clips stretch out along with the fourth push rod;

The third synchronous racks are used for enabling the guide shoes and the electricity collection clips to be telescopic synchronously.

According to one exemplary implementation manner of the present disclosure, each supporting mechanism also comprises a plurality of second running wheels arranged on both sides of the supporting mechanism.

According to one exemplary implementation manner of the present disclosure, each supporting mechanism also comprises a rechargeable battery pack.

According to one exemplary implementation manner of the present disclosure, the power used for vertical movement of the supporting mechanism is obtained from the trolley conductors through the electricity collection clips, and the supporting mechanism is capable of running through the power of own batteries when the supporting mechanism moves horizontally.

According to one exemplary implementation manner of the present disclosure, the storage warehouse system also comprises two supporting mechanism horizontal movement layers; the two supporting mechanism horizontal movement layers are respectively located on the uppermost layer and the lowermost layer of the storage warehouse system; second rails for horizontal movement of the supporting mechanism are arranged on the supporting mechanism horizontal movement layer on the uppermost layer; and third rails for horizontal movement of the supporting mechanism are arranged on the supporting mechanism horizontal movement layer on the lowermost layer;

The uppermost layer of each shaft is provided with first supplementary rails and fifth push rods, and the fifth push rods are arranged horizontally and are telescopic; the fifth push rods are vertically connected with the first supplementary rails; the first supplementary rails are parallel to the second rails on the uppermost layer and can be connected with or separated from the second rails on the uppermost layer along with horizontal movement of the fifth push rods; and when the first supplementary rails are connected with the second rails on the uppermost layer, the supporting mechanism is capable of running from the first supplementary rails onto the second rails;

The third rails extend to the lowermost layer of the shaft, so that the supporting mechanism is capable of running on the third rails.

According to one exemplary implementation manner of the present disclosure, horizontal gear guide plates are also arranged on the supporting mechanism horizontal movement layer; and the gear guide plates are the same as the tooth shape of the vertical racks and are in alignment with the vertical racks, so that the movement gears can horizontally slide on the gear guide plates.

According to one exemplary implementation manner of the present disclosure, fourth calibrating and positioning devices are arranged on the supporting mechanism, and fifth calibrating and positioning devices corresponding to the fourth calibrating and positioning devices are arranged on the third rails on the lowermost layer of the shaft.

According to one exemplary implementation manner of the present disclosure, each fifth calibrating and positioning device comprises a third positioning hole; each fourth calibrating and positioning device comprises a fifth push rod arranged vertically and a third telescopic tongue fixed at the lower end of the fifth push rod; and the third telescopic tongue can be inserted into the third positioning hole.

According to one exemplary implementation manner of the present disclosure, the lower end of the third telescopic tongue is in a cone shape.

According to one exemplary implementation manner of the present disclosure, the supporting mechanism lifting apparatus comprises four chains, two double-row lifting chain wheels, a second motor, two bend chain wheels and weights; the second motor is connected with the double-row lifting chain wheels and is used for driving the double-row lifting chain wheels to rotate; the chains are arranged on the double-row lifting chain wheels and move up and down along with the rotation of the double-row lifting chain wheels; two of the chains pass through the bend chain wheels; one end of each chain is connected with the weight, and the other ends of the chains are connected with the supporting mechanism.

According to one exemplary implementation manner of the present disclosure, the storage warehouse system also comprises criss-crossed transfer rail systems; each criss-crossed transfer rail system comprises longitudinal rails and first transverse rails that are vertically intersected; the longitudinal rails and the first transverse rails are all arranged horizontally; the first transverse rails are parallel to the first rails; the first transverse rails or the longitudinal rails are disconnected at the junctions of the first transverse rails and the longitudinal rails; and the first transverse rails or the longitudinal rails can move up and down along the vertical direction to be higher or lower than the longitudinal rails or the first transverse rails;

The longitudinal rails are vertically intersected with the supporting mechanism; the longitudinal rails are disconnected at the junctions of the longitudinal rails and the supporting mechanism; and the supporting mechanism can move up and down along the vertical direction to be higher or lower than the longitudinal rails;

The self-delivering trolley can move on the longitudinal rails and the first transverse rails; and the self-delivering trolley can switch the rails along with the up-and-down movement of the longitudinal rails or the first transverse rails and can also switch the longitudinal rails and the guide rails along with the up-and-down movement of the supporting mechanism.

According to one exemplary implementation manner of the present disclosure, the main frame of the self-delivering trolley is rectangular, and the self-delivering trolley also comprises a plurality of third running wheels arranged on the other two sides of the main frame.

According to one exemplary implementation manner of the present disclosure, the third running wheels are used for running on the longitudinal rails, and the first running wheels are also used for running on the transverse rails.

According to one exemplary implementation manner of the present disclosure, the first steel upright columns, the second steel upright columns, the guide post, the lifting rods, the first rail, the second rails, the first supplementary rails, the third rails, the fourth fixed rail and the guide rails are all in a rigid structure.

The present disclosure has the following beneficial effects that:

The present disclosure provides the single-row multilayer storage warehouse system with vertical avoidance, which is more efficient and labor-saving in storage and pick-up of the goods; the goods that are stored and picked up include automobiles, containers and the like. The storage warehouse system is specifically described in the following aspects:

(1) The storage warehouse system adopts a manner of vertical avoidance; and when the goods are stored and picked up, the trolley can move without waiting for the movement of all obstacle goods, and the trolley is capable of running to the storage shelves while vertical avoidance is carried out, thereby improving the storage and pick-up efficiency.

(2) The storage warehouse system can comprise a plurality of self-delivering trolleys, and multiple goods can be stored and picked up in a short time.

(3) In the storage warehouse system, the gears are adopted for enabling the supporting mechanism to move up and down, and meanwhile, the supporting mechanism can also move horizontally on the uppermost layer and on the lowermost layer, so as to form a major cycle path; the self-delivering trolley is used for transporting the goods through the shaft at one end and leaves the storage layer through the shaft at the other end, so as to form a minor cycle path; and the storage and pick-up of the goods are not conflicted with each other, the multiple goods can be stored and picked up at the same time, and the next goods can be stored and picked up without waiting for complete storage and pick-up of the previous goods.

(4) In the storage warehouse system, through adoption of a plurality of positioning devices, the self-delivering trolley can be precisely positioned when in storage and pick-up of the goods.

(5) In the storage warehouse system, through adoption of leveling and positioning devices, the guide rails on the supporting mechanism and the first rail can be precisely positioned.

(6) The criss-crossed transfer rail systems of the storage warehouse system can be directly used for transferring the goods out of the storage warehouse system or transferring the goods in the storage warehouse system.

Figure 1:
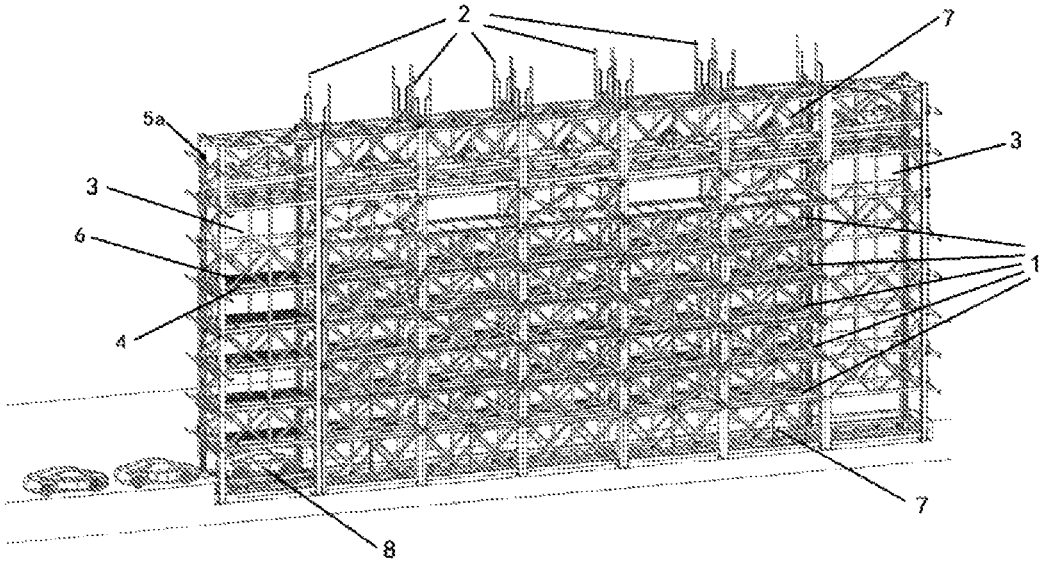
FIG. 1 shows a structural diagram of a storage warehouse system in a first implementation manner.

1—storage layer, 11—storage shelf, 111—first supporting component, 112—dust blocking plate, 12—first rail, 13—fourth fixed rail, 14—guide post, 141—lifting bayonet, 142—roller bearing and 143—guide post shell;

2—storage shelf lifting apparatus, 21—first steel upright column, 211—guide groove, 23—lifting rod, 231—lifting hook section, 2311—hook arm, 2312—first pin, 2313—torsional spring, 2314—telescopic sleeve, 2315—third push rod, 232—opening, 233—hollow shell, 234—drag chain, 24—first power mechanism, 241—hydraulic station, 242—hydraulic cylinder, 243—hydraulic cylinder telescopic rod, 244—hydraulic cylinder base, 25—synchronization mechanism, 251—second synchronous rack, 252—longitudinal synchronous shaft, 253—second synchronous gear, 254—third synchronous gear, 255—transverse synchronous shaft, 256—fourth synchronous gear, 26—fall prevention mechanism, 261—fall prevention non-return rack, 262—decompression fall-prevention device, 2621—non-return tongue, 2622—DC coil body, 2623—torsional spring, 2624—second pin, 2625—third pin, 2626—decompression fall-prevention device substrate, 27—first joining beam, 28—third supplementary rail, 29—second joining beam and 30—fifth supplementary rail;

3—shaft, 31—forcible leveling female seat, 32—first supplementary rail, 33—fifth push rod, 34—overhaul position supplementary rail device, 341—sixth supplementary rail, 342—sixth push rod, 35—extension movement gear guide plate and 36—second steel upright column;

4—supporting mechanism, 41—guide rail, 42—forcible leveling device, 421—first telescopic tongue, 422—first synchronous rack, 423—first synchronous gear, 424—first push rod, 425—forcible leveling jacket, 426—adjusting device, 43—second running wheel, 44—first calibrating and positioning device and 45—fourth calibrating and positioning device;

5*a*—supporting mechanism lifting apparatus in a first implementation manner, 5*a*-1—vertical rack, 5*a*-2—vertical guide rail, 5*a*-3—trolley conductor, 5*a*-4—movement gear, 5*a*-5—first motor, 5*a*-6—guide shoe, 5*a*-7—electricity collection clip, 5*a*-71—electricity collection clip plate, 5*a*-72—-insulated base, 5*a*-73—closed spring, 5*a*-74—fourth pin, 5*a*-75—wiring lug, 5*a*-8—fourth push rod and 5*a*-9—third synchronous rack;

5*b*—supporting mechanism lifting apparatus in a fourth implementation manner, 5*b*-1—chain, 5*b*-2—double-row lifting chain wheel, 5*b*-3—second motor, 5*b*-4—weight and 5*b*-5—bend chain wheel;

6—self-delivering trolley, 61—main frame, 62—first running wheel, 63—second supporting component, 64—goods lifting mechanism, 65—third calibrating and positioning device, 651—second push rod, 652—second telescopic tongue, 66—third running wheel and 67—seventh calibrating and positioning device;

7—supporting mechanism horizontal movement layer, 71—second rail, 72—gear guide plate and 73—third rail;

8—goods;

91—second transverse rail, 92—criss-crossed transfer rail system, 921—longitudinal rail, 922—first transverse rail, 93—container storage and pick-up warehouse, 94—inter-warehouse transfer rail, 96—container loading and unloading vehicle device;

10—quay crane and 101—quay crane movable rail.

DETAILED DESCRIPTION OF PREFERRED EMBODIMENTS

Embodiments of the present disclosure are described in detail hereinafter, and the present disclosure can be implemented by various manners limited and covered by the claims.

Figure 2:
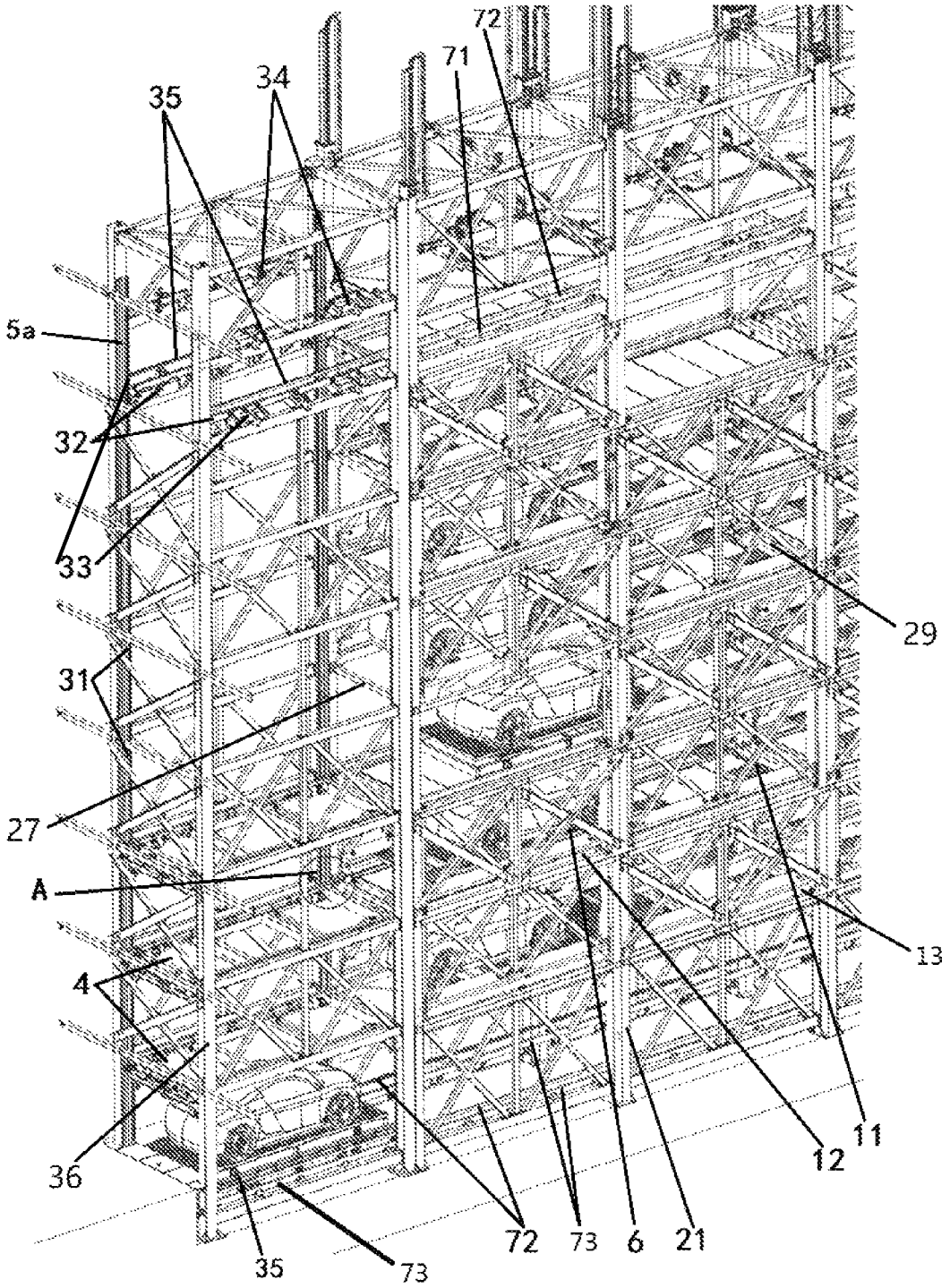
FIG. 2 shows a local structural diagram of the storage warehouse system in the first implementation manner.

According to a first specific implementation manner of the present disclosure, the present disclosure provides a single-row multilayer storage warehouse system with vertical avoidance. As shown in FIGS. 1-2, the single-row multilayer storage warehouse system comprises a plurality of storage layers 1, a plurality of storage shelf lifting apparatus 2, shafts 3, supporting mechanisms 4, supporting mechanism lifting apparatus 5*a*, a plurality of self-delivering trolleys 6 and two supporting mechanism horizontal movement layers 7.

The storage layers 1 include 2-6 layers, wherein the seventh layer is vacated for providing a space for upward movement of goods 8 on the sixth layer; more storage layers 1 can be arranged according to actual requirements; and only the upper layer of the storage layer 1 on the uppermost layer needs to be vacated. The first layer and the eighth layer are the supporting mechanism horizontal movement layers 7 for horizontal movement of the supporting mechanisms 4. The two shafts 3 are arranged at both ends of the storage warehouse system, and the supporting mechanism lifting apparatus 5*a* is configured to enable the supporting mechanisms 4 to move up and down in the shafts 3.

As shown in FIGS. 1, 2 and 4-7, each storage layer 1 is provided with five storage shelf groups arranged side by side; each storage shelf group comprises two storage shelves 11 arranged symmetrically; and each storage layer 1 can be provided with seven/eight/even more storage shelf groups according to actual requirements. Each storage shelf group is in a cuboid structure; each storage shelf group corresponds to four guide posts 14; and the four guide posts 14 are respectively and vertically fixed on four vertical sides of the storage shelf group. The length of each guide post 14 is equal to the height of each storage layer 1, and the storage shelf groups are directly stacked one by one from bottom to top, so that each storage shelf lifting apparatus 2 can be configured to directly control the storage shelf groups in the same vertical direction. A dust blocking plate 112 (which is in non-rigid connection or is not arranged) is arranged at the upper part of each storage shelf group, and a first supporting component 111 for storing the goods 8 is arranged at the lower part of the storage shelf group. First rails 12 are fixed at the top of each of the storage shelves 11, except the storage shelves 11 on the uppermost layer, and the first rail 12 may be not arranged on the storage shelves 11 on the uppermost layer. A fourth fixed rail 13 is fixed under each of the storage shelves 11 on the lowermost layer. On the storage layers 1, except the storage layer 1 on the lowermost layer, the self-delivering trolleys 6 are capable of running on the first rails 12 on the same layer through third supplementary rails 28 on first joining beams 27 and fifth supplementary rails 30 on second joining beams 29. On the storage layer 1 on the lowermost layer, the self-delivering trolleys 6 are capable of running on the fourth fixed rails 13 through third supplementary rails 28 on first joining beams 27. Second calibrating and positioning devices are arranged on the first rails 12 and the fourth fixed rails 13, and the second calibrating and positioning devices are second positioning holes.

As shown in FIGS. 2-6, a plurality of first joining beams 27 arranged horizontally are arranged between two first steel upright columns 21 that are near each shaft 3; the third supplementary rails 28 are arranged on the first joining beams 27; the third supplementary rails 28 are connected with guide rails 41 and the first rails 12 or the fourth fixed rails 13; a plurality of second joining beams 29 arranged horizontally are arranged between every two of other first steel upright columns 21; the fifth supplementary rails 30 are arranged on the second joining beams 29; and each fifth supplementary rail 30 is connected with every two adjacent first rails 12.

Figure 4:
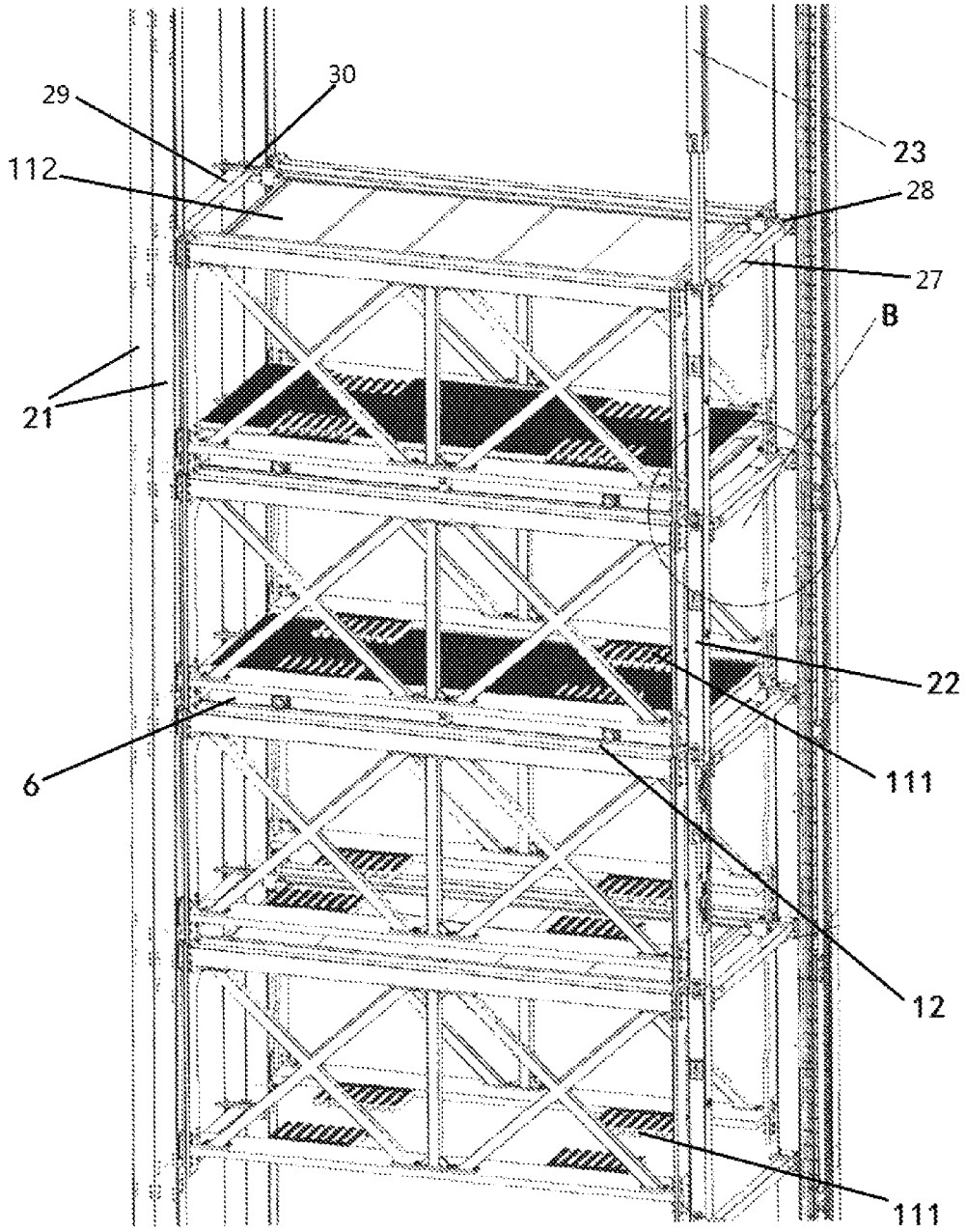
FIG. 4 shows a structural diagram of storage shelves in a same vertical direction on the rightmost side of storage layers.
Figure 5:
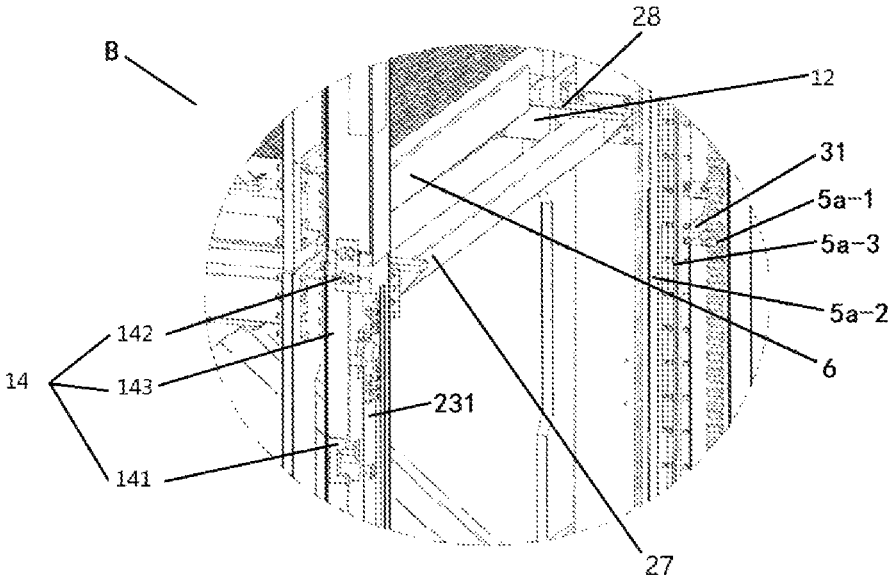
FIG. 5 shows a structural diagram of part B in FIG. 4.
Figure 9:
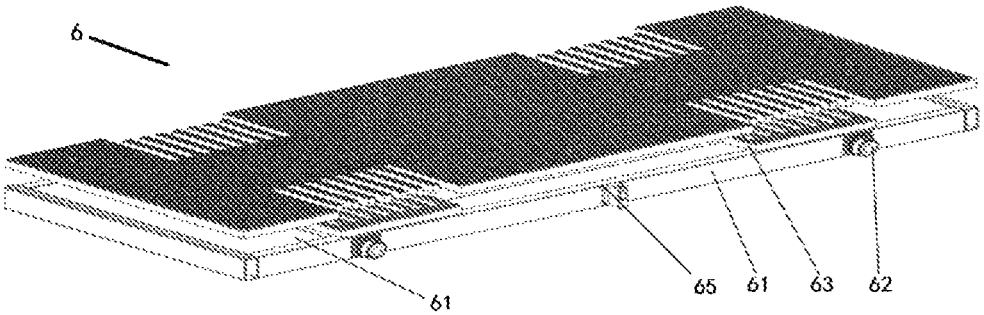
FIG. 9 shows a structural diagram of a self-delivering trolley.

As shown in FIGS. 2, 4 and 9, each self-delivering trolley 6 comprises a rectangular main frame 61, a rechargeable battery pack, first running wheels 62 located on both sides of the main frame 61, a second supporting component 63 arranged above the main frame 61, a goods lifting mechanism (which is internally arranged and is not shown in the figures) and third calibrating and positioning devices 65. The first running wheels 62 are used for enabling the self-delivering trolley 6 to move on the first rails 12, the fourth fixed rails 13, the third supplementary rails 28, the fifth supplementary rails 30 and the guide rails 41 on the supporting mechanisms 4. The goods 8 are placed on the second supporting component 63, and the goods lifting mechanism is used for enabling the second supporting component 63 and the goods 8 to move up and down, so that the second supporting component 63 is higher or lower than the first supporting component 111. The goods lifting mechanism is capable of lifting the second supporting component 63 to the highest point above the first supporting component 111, and of lowering the second supporting component 63 to a lowest point below the first supporting component 111. When the self-delivering trolley 6 is located right under one storage shelf group, the position of the second supporting component 63 is staggered with the horizontal position of the first supporting component 111.

Figure 10:
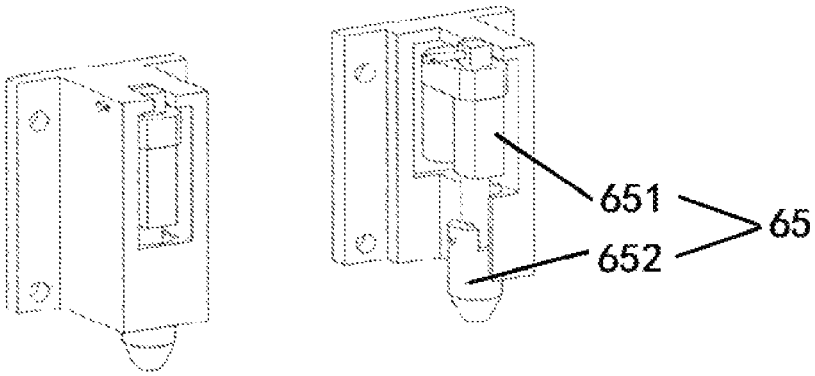
FIG. 10 shows a structural diagram of a third calibrating and positioning device.

In FIG. 4, the first supporting component 111 is in a comb shape, and the positions corresponding to the first supporting component 111 on each second supporting component 63 are vacated to form comb shapes. As shown in FIGS. 9-10, each third calibrating and positioning device 65 is arranged in the middle of each of the long edges of the main frame 61; the third calibrating and positioning device 65 comprises a second push rod 651 arranged vertically and a second telescopic tongue 652 fixed at the lower end of the second push rod; and the lower end of the second telescopic tongue 652 is in a cone shape (which has a function of calibration) and can be inserted into the second positioning hole.

As shown in FIGS. 1 and 4, when each self-delivering trolley 6 moves on the first rails 12 or the fourth fixed rails 13 on the same layer through the third supplementary rails 28 on the first joining beams 27 and the fifth supplementary rails 30 on the second joining beams 29, if the goods 8 are not in front of the self-delivering trolley 6, two situations are described as follows: when the self-delivering trolley 6 is empty, the goods lifting mechanism descends to the lowest point, and the second supporting component 63 is lower than the first supporting component 111, so that the self-delivering trolley 6 can directly run between the first rail 12 on the storage shelves 11 on the lower layer and the bottom of the first supporting component 111 of the storage shelves 11 on the layer; and when the self-delivering trolley 6 is loaded with the goods 8, the goods lifting mechanism ascends to the highest point, and the second supporting component 63 is higher than the first supporting component 111, so that the self-delivering trolley 6 is capable of running through the storage shelves 11, the goods 8 are not blocked by the first supporting component 111, and a safety passing distance is left between the top of the goods and the bottom of the first supporting component 111 of the storage shelves 11 on the upper layer. When the self-delivering trolley 6 moves on the first rail 12 or the fixed rails 13 on the same layer through the third supplementary rails 28 on the first joining beams 27 and the fifth supplementary rails 30 on the second joining beams 29, if the goods 8 are in front of the self-delivering trolley 6, the storage shelf group 11 loaded with the goods 8 and all groups of storage shelves 11 right above the storage shelf group 11 are moved upwards by the storage shelf lifting apparatus 2. Each storage shelf lifting apparatus 2 is used for driving all storage shelves 11 in the same vertical direction to move up and down. In FIG. 1, each storage layer 1 comprises five groups of storage shelves 11, and therefore, the number of the storage shelf lifting apparatus 2 is five. Each storage shelf lifting apparatus 2 comprises four first steel upright columns 21, four lifting rods 23, a first power mechanism 24, a synchronization mechanism 25 and fall prevention mechanisms 26.

As shown in FIGS. 4-5 and 6-8, the first steel upright columns 21 are arranged vertically, and a guide groove 211 is formed in each first steel upright column 21, so that the four guide posts 14 respectively move up and down in the guide grooves 211 of the four first steel upright columns 21 through roller bearings 142 arranged on the guide post 14. The guide posts 14 are in a hollow structure, and each lifting rod 23 vertically penetrates through the interior of all the guide posts 14 on the same first steel upright column 21, so as to string the guide posts 14. A rigid supporting seat is arranged at the bottom of each first steel upright column 21, and the rigid supporting seats are used for supporting the guide post 14 of the storage shelves on the lowermost layer.

Figure 11:
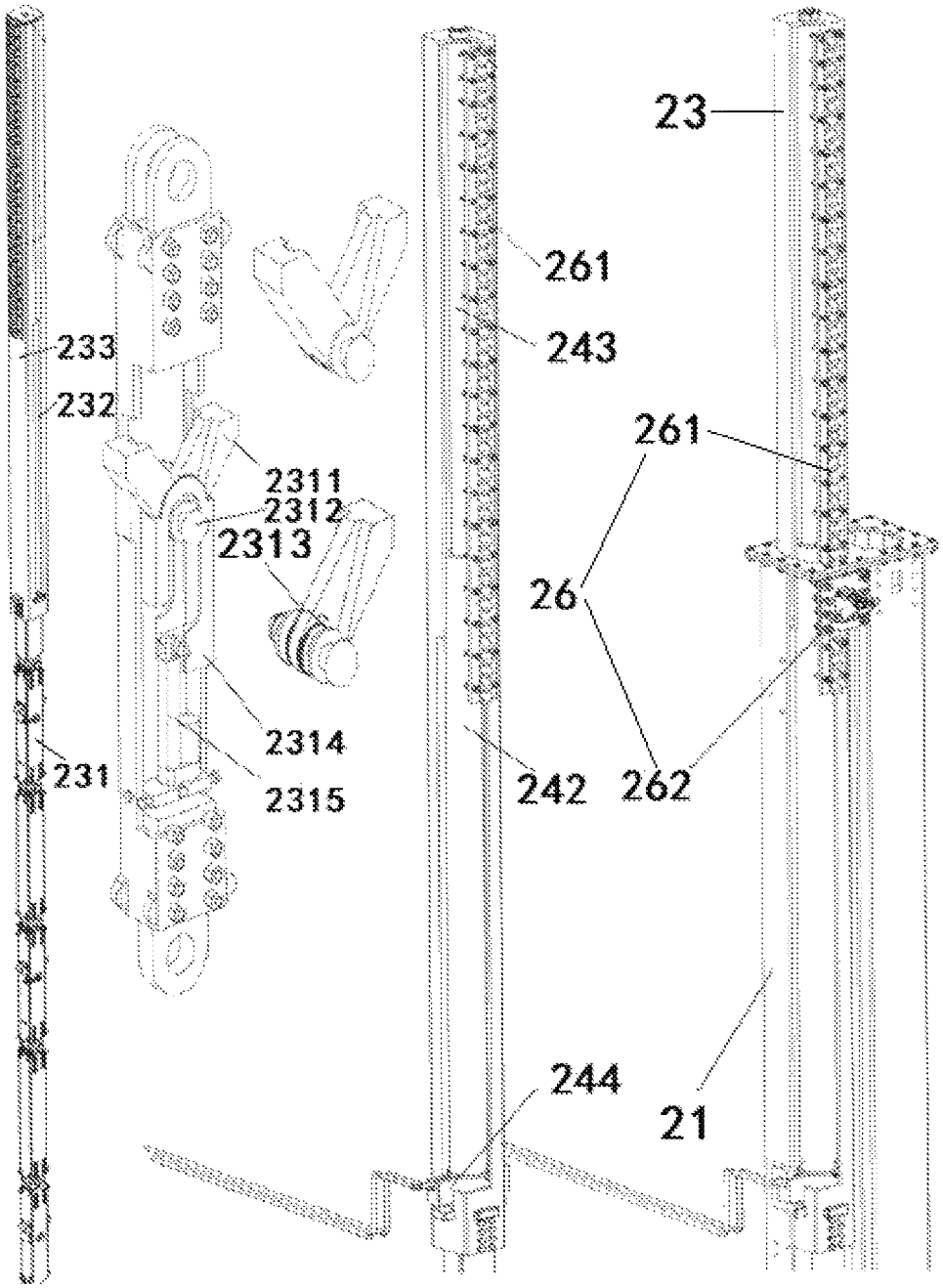
FIG. 11 shows a diagram of a structure of a lifting rod and a connection relationship diagram of the lifting rod and a first power mechanism.

As shown in FIG. 11, the upper part of each lifting rod 23 is connected with the first power mechanism 24, the lower part of the lifting rod 23 comprises a plurality of lifting hook sections 231, and each lifting hook section 231 corresponds to one guide post 14.

Figure 12:
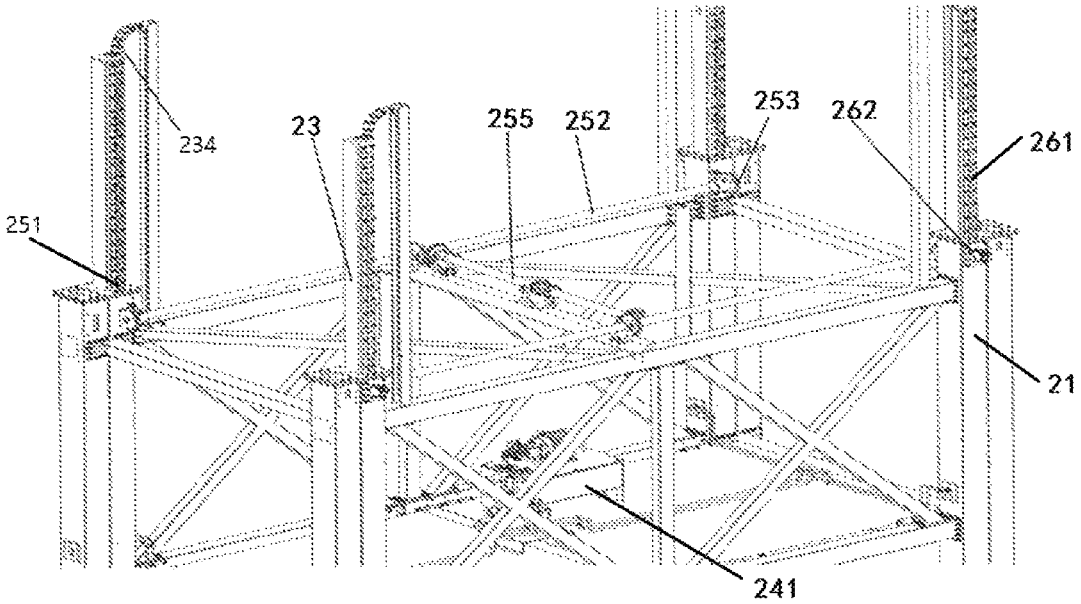
FIG. 12 shows a structural diagram of the top of a storage shelf lifting apparatus.
Figure 13:
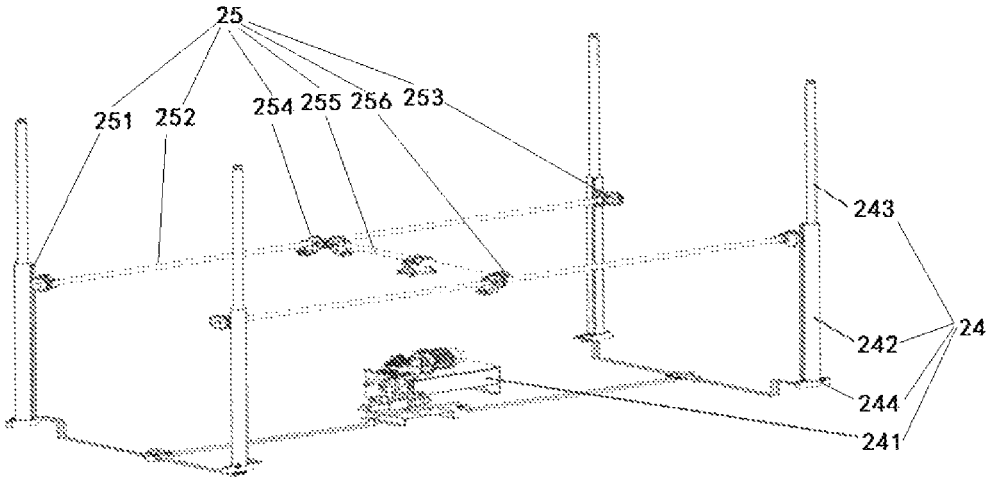
FIG. 13 shows a structural diagram of the first power mechanism and a synchronization mechanism.
Figure 14:
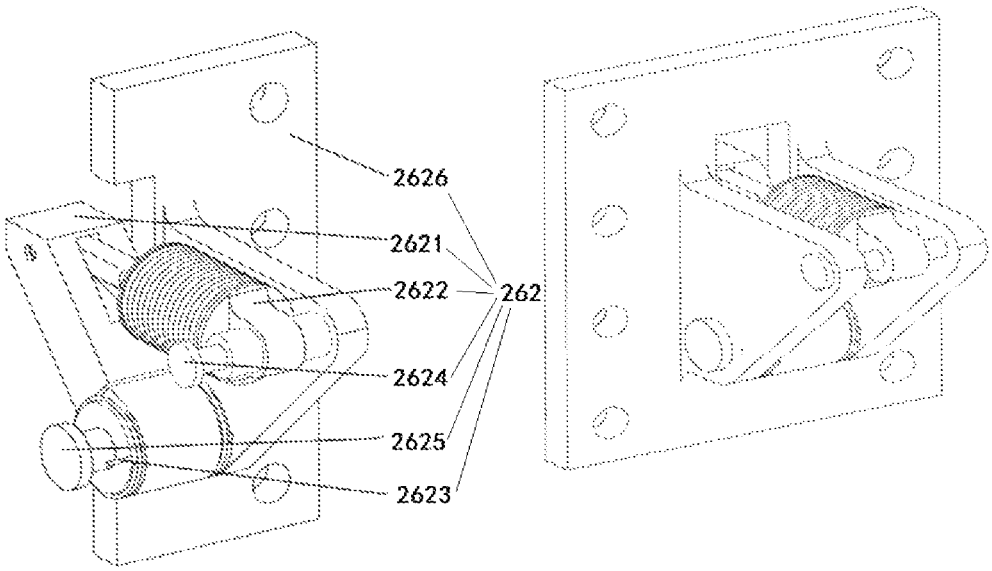
FIG. 14 shows a structural diagram of a decompression fall-prevention device.

As shown in FIGS. 11-13, the first power mechanism 24 comprises a hydraulic station 241, hydraulic cylinders 242, hydraulic cylinder telescopic rods 243 arranged vertically and hydraulic cylinder bases 244 arranged at the bottom of the hydraulic cylinders 242. The upper part of each lifting rod 23 is a hollow shell 233 with an opening 232 in the vertical direction; the hydraulic cylinder 242, the hydraulic cylinder telescopic rod 243 and the hydraulic cylinder base 244 are all arranged in the hollow shell 233; and the top of the hydraulic cylinder telescopic rod 243 is connected with the top of the lifting rod 23. The hydraulic cylinder bases 244 connected with the hydraulic station 241 are arranged at the bottom of the hydraulic cylinders 242; the hydraulic cylinder bases 244 stretch outwards through the openings 232 and are fixedly connected with the first steel upright columns 21; and when the lifting rods 23 are driven to move upwards by the hydraulic cylinder telescopic rods 243, the openings 232 move up and down relatively to the hydraulic cylinder bases 244.

As shown in FIGS. 4-5, 7-8 and 11, each guide post 14 comprises a guide post shell 143, lifting bayonets 141 that are symmetrically formed in the side surfaces of the guide post shell 143, and the roller bearings 142 that are arranged on the outer surface of the guide post shell 143. The lifting hook sections 231 are surrounded by the guide post shell 143, each lifting hook section 231 is provided with a lifting hook at a position corresponding to the lifting bayonet 141, and a telescopic sleeve 2314 and a third push rod 2315 are arranged at the lower part of the lifting hook. The lifting hook is in a V-shaped structure; the lifting hook comprises two hook arms 2311, a first pin 2312 used for connecting the two hook arms 2311 and a torsional spring 2313 arranged at the connecting position of the two hook arms 2311; and in a normal state, the two hook arms 2311 are opened in a V-shaped structure under the elasticity of the torsional spring 2313. The third push rod 2315 and the telescopic sleeve 2314 are fixedly connected with each other and are telescopic in the vertical direction. The telescopic sleeve 2314 is in a hollow rectangular tubular structure, the connecting position of the two hook arms 2311 is arranged at the upper part of the telescopic sleeve 2314. The telescopic sleeve 2314 can move up and down along with the third push rod 2315, and the two hook arms 2311 are sleeved in or released out of the telescopic sleeve 2314. When the two hook arms 2311 are released out of the telescopic sleeve 2314, the two hook arms 2311 are opened outwards and are connected with the lifting bayonets 141 in a clamping manner, and at the moment, the lifting rods 23 move upwards to drive the guide post 14 and the storage shelves 11 connected with the guide post 14 to move upwards; and when the two hook arms 2311 are sleeved in the telescopic sleeve 2314, the two hook arms 2311 draw back inwards, the lifting rods 23 move upwards at the moment, and the guide post 14 and the storage shelves 11 connected with the guide post 14 do not move upwards along with the lifting rods 23. When the guide post 14 move up and down, the roller bearings 142 are in touch with the guide grooves 211 of the first steel upright columns 21 and roll in the guide grooves 211, so as to be favorable for reducing friction.

Figure 15:
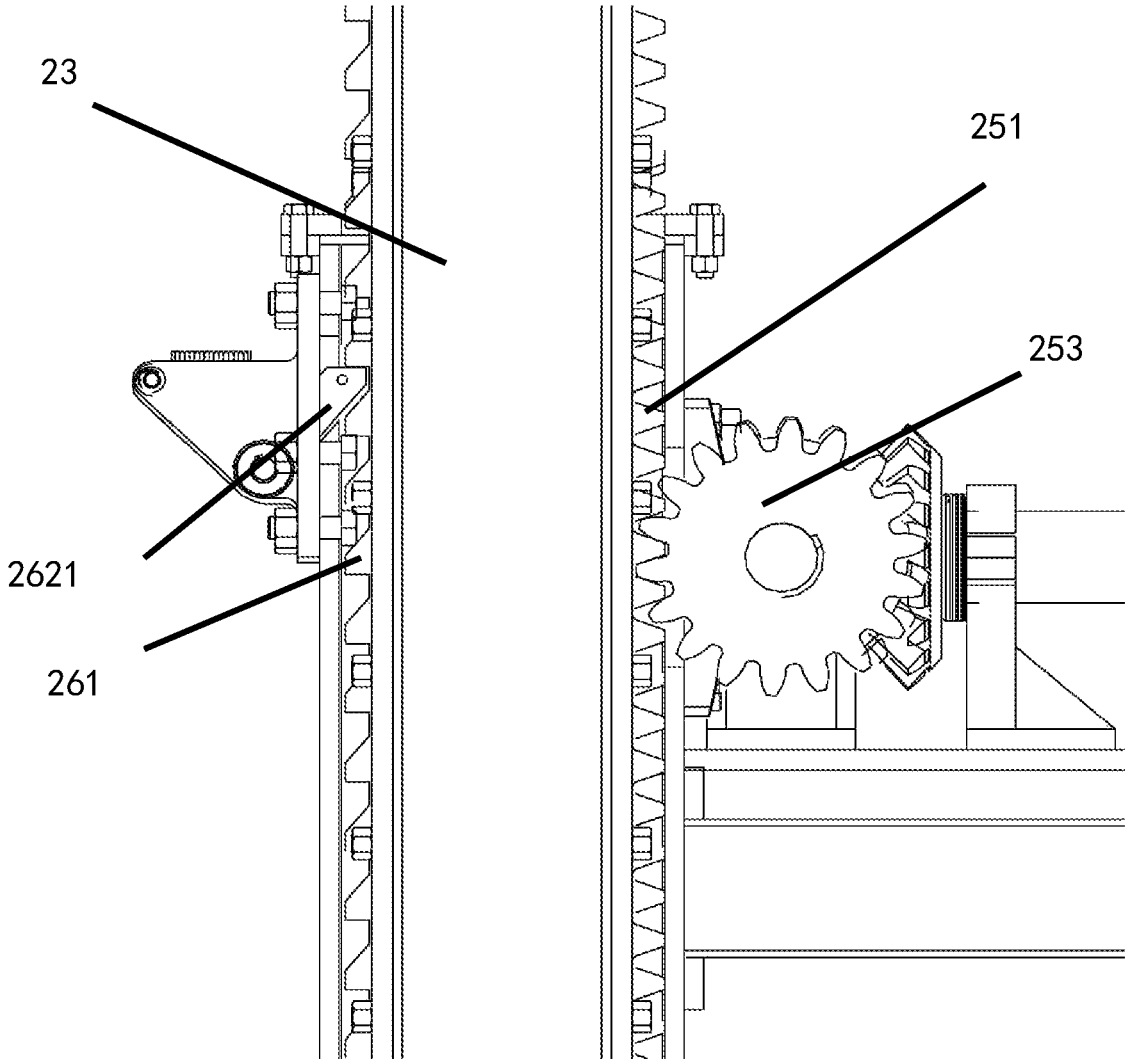
FIG. 15 shows a schematic diagram that a non-return tongue is clamped with a fall prevention non-return rack.
Figure 16:
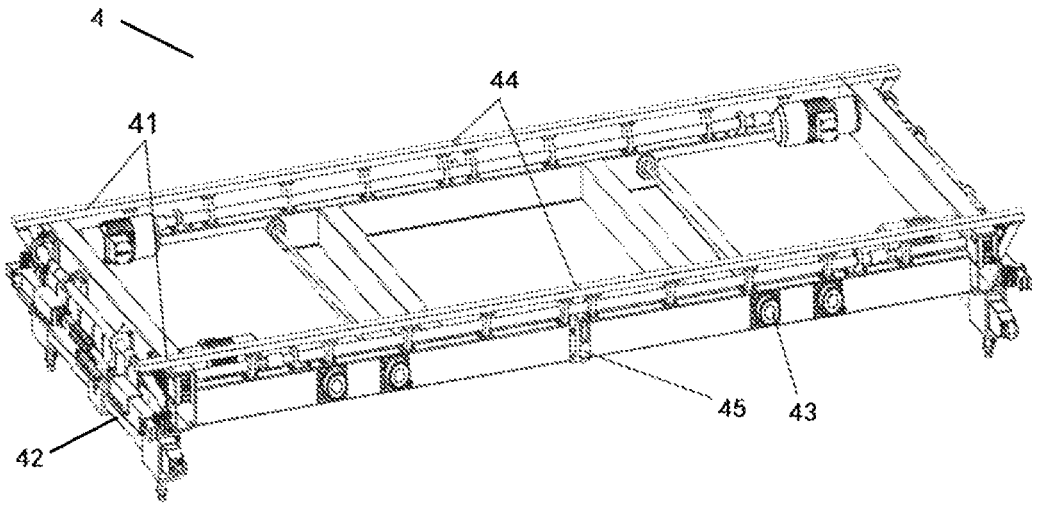
FIG. 16 shows a structural diagram of a supporting mechanism.
Figure 17:
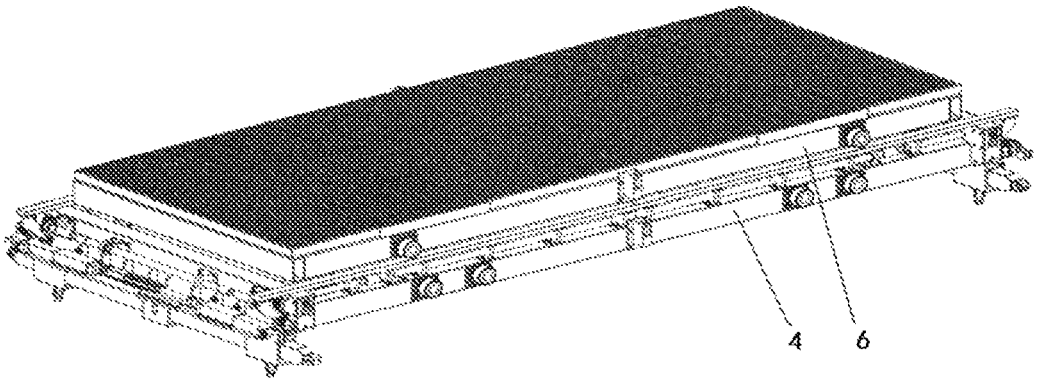
FIG. 17 shows a structural diagram that the self-delivering trolley is carried by the supporting mechanism.
Figure 18:
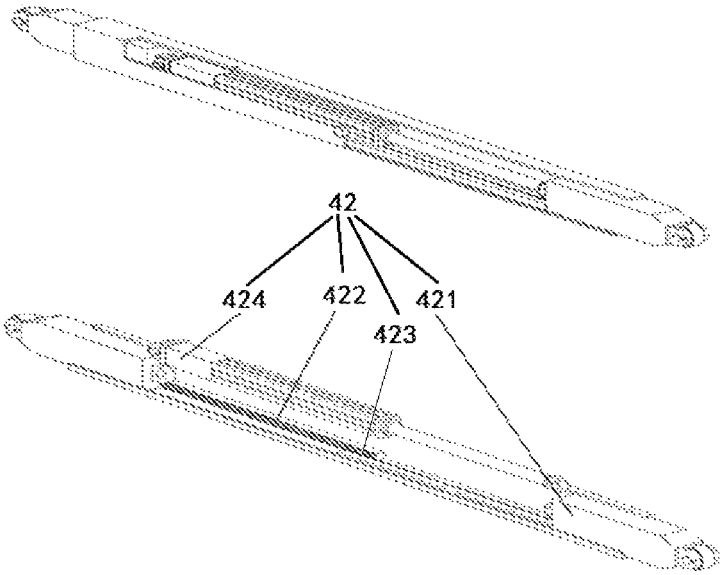
FIG. 18 shows a structural diagram of a forcible leveling device.

As shown in FIGS. 12-13 and 15, each storage shelf lifting apparatus 2 is provided with four lifting rods 23, and the synchronization mechanism 25 is used for enabling the four lifting rods 23 to go up and down synchronously. The synchronization mechanism 25 comprises four second synchronous racks 251 that are vertically fixed at the upper parts of the lifting rods 23, two longitudinal synchronous shafts 252, four second synchronous gears 253, two third synchronous gears 254, a transverse synchronous shaft 255 and two fourth synchronous gears 256. The longitudinal synchronous shafts 252 and the transverse synchronous shaft 255 are all horizontally arranged, and the longitudinal synchronous shafts 252 are perpendicular to the transverse synchronous shaft 255 to form an H shape. The second synchronous racks 251 are vertically fixed at the upper parts of the lifting rods 23 and move up and down along with the lifting rods 23. The second synchronous gears 253 are arranged at both ends of the longitudinal synchronous shafts 252 and are meshed with the second synchronous racks 251. The third synchronous gears 254 are arranged in the middle of the longitudinal synchronous shafts 252, the fourth synchronous gears 256 are arranged at both ends of the transverse synchronous shaft 255, and the third synchronous gears 254 and the fourth synchronous gears 256 are bevel gears and are meshed with each other.

As shown in FIG. 12, each lifting rod 23 also comprises a drag chain 234; a power and control signal cable is connected into the lifting rod 23 from the upper part of the lifting rod 23 by the drag chain 234; and the power and control signal cable is connected with the lifting hook sections 231 and is used for providing a control signal and controlling opening and closing of each lifting hook as well as feedback signal communication of states and positions.

As shown in FIGS. 11 and 13-15, the fall prevention mechanisms 26 can prevent the lifting rods 23 from falling down when the first power mechanism 24 is decompressed. Each fall prevention mechanism 26 comprises a fall prevention non-return rack 261 and a decompression fall-prevention device 262. The fall prevention non-return rack 261 is vertically fixed at the upper part of the lifting rod 23. The decompression fall-prevention device 262 is fixed on the first steel upright column 21, and the decompression fall-prevention device 262 comprises a non-return tongue 2621, a DC (Direction Current) coil body 2622, a torsional spring 2623, a second pin 2624, a third pin 2625 and a decompression fall-prevention device substrate 2626. The decompression fall-prevention device substrate 2626 is fixedly connected with the first steel upright column 21, one end of the non-return tongue 2621 is articulated with a magnet core body in the DC coil body 2622, and the DC coil body 2622 is articulated with the decompression fall-prevention device substrate 2626 by the second pin 2624; and the other end of the non-return tongue 2621 is vertically connected with the torsional spring 2623 and is fixed on the decompression fall-prevention device substrate 2626 by the third pin 2625. The non-return tongue 2621 is capable of rotating along the axial direction of the torsional spring 2623, so that the non-return tongue 2621 is clamped with or separated from the fall prevention non-return rack 261. In a normal state, the DC coil body 2622 remains charged and is used for pulling the non-return tongue 2621 away from the fall prevention non-return rack 261; and when a hydraulic system is decompressed (such as the crack of an oil pipe and the like), a pressure sensor of the hydraulic system is configured to send a signal, the electricity of the DC coil body 2622 is cut off by a control system in time, and the non-return tongue 2621 is rotated under the torsion of the torsional spring 2623 and is clamped with the fall prevention non-return rack 261, so as to avoid falling down of the lifting rod 23.

As shown in FIGS. 1-2, 16-17 and 20-22, the supporting mechanism 4 comprises a rectangular frame body; and the guide rails 41 which are parallel to the first rails 12 are arranged at the top of the frame body, so that when the supporting mechanism 4 stays on each storage layer 1, the guide rails 41 are connected with all the first rails 12 or all the fourth fixed rails 13 on the layer to form a continuous rail through the third supplementary rails 28 and the fifth supplementary rails 30, and the self-delivering trolley 6 is capable of running from the first rails 12 or the fourth fixed rails 13 on the same layer onto the guide rails 41 or run from the guide rails 41 onto the first rails 12 or the fourth fixed rails 13 on the same layer. A plurality of running wheels 43, first calibrating and positioning devices 44 and fourth calibrating and positioning devices 45 are arranged on both sides of the supporting mechanism 4. The running wheels 43 are used for moving on the supporting mechanism horizontal movement layer 7. The first calibrating and positioning devices are first positioning holes, are arranged on the guide rails 41 and can be inserted by the second telescopic tongues on the self-delivering trolley 6. The fourth calibrating and positioning devices 45 are arranged in the middle of the long edges of the frame body; the structure of the fourth calibrating and positioning device 45 is similar to that of the third calibrating and positioning device 65; the fourth calibrating and positioning device 45 comprises a fifth push rod arranged vertically and a third telescopic tongue fixed at the lower end of the fifth push rod; and the lower end of the third telescopic tongue is in a cone shape. The supporting mechanism 4 also comprises a rechargeable battery pack which is used for driving the supporting mechanism 4 to move on the supporting mechanism horizontal movement layer 7.

Figure 3:
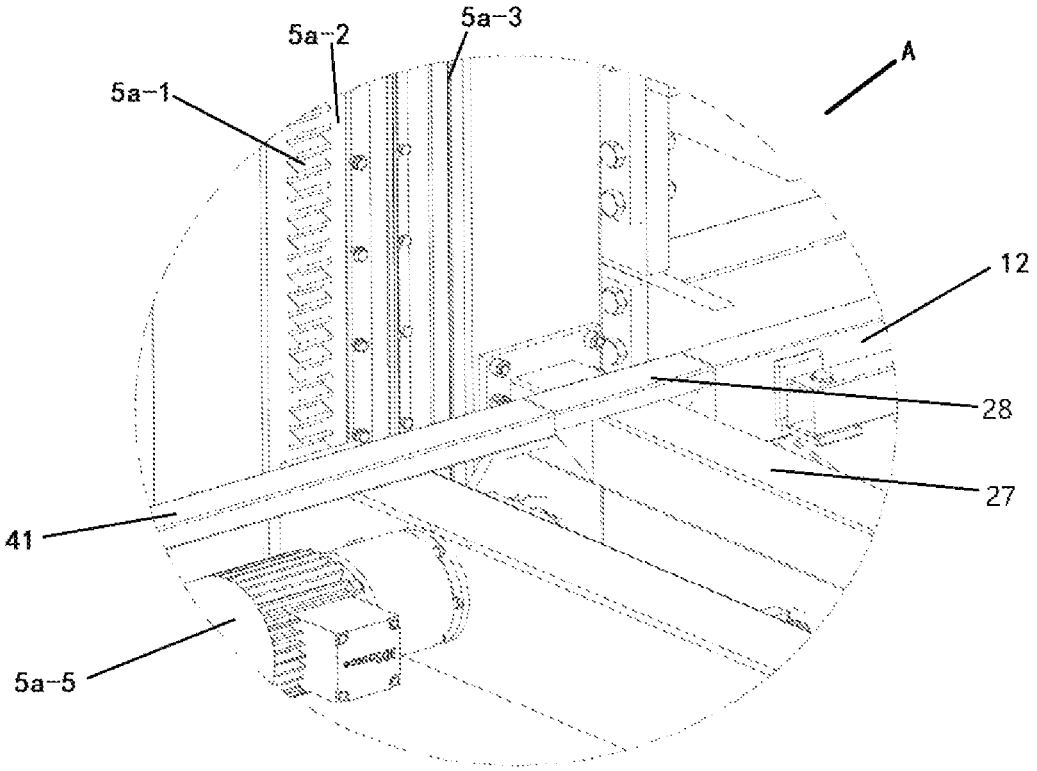
FIG. 3 shows a structural diagram of part A in FIG. 2.
Figure 6:
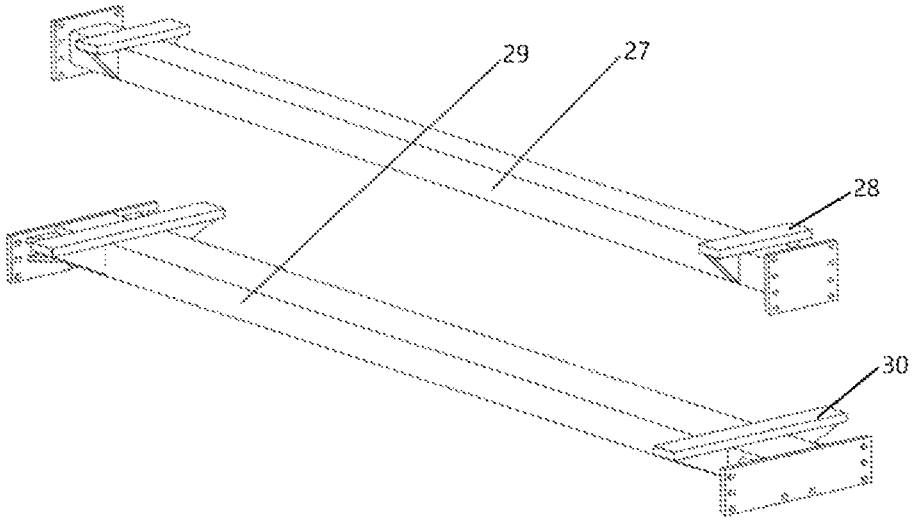
FIG. 6 shows structural diagrams of a first joining beam and a second joining beam.
Figure 7:
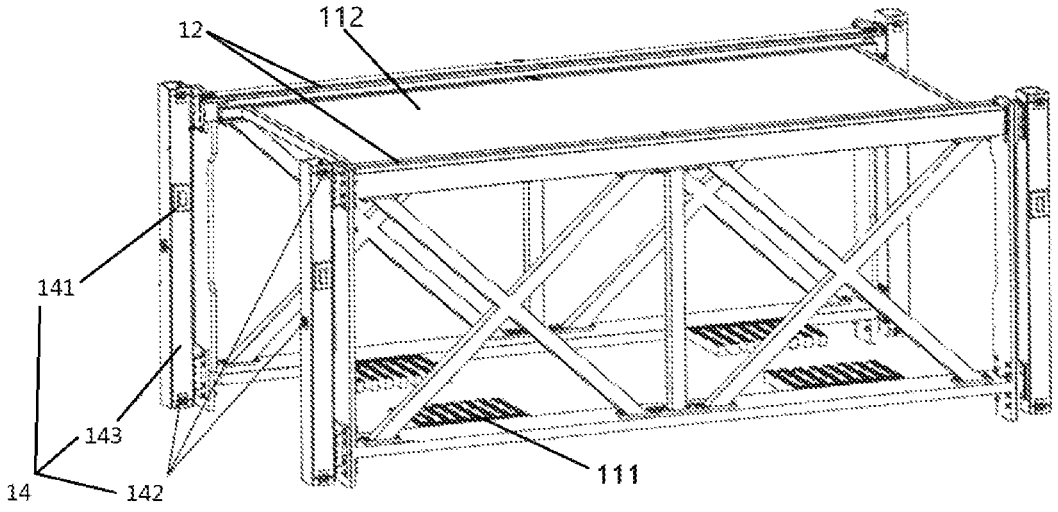
FIG. 7 shows a relationship diagram of two storage shelves arranged symmetrically.
Figure 8:
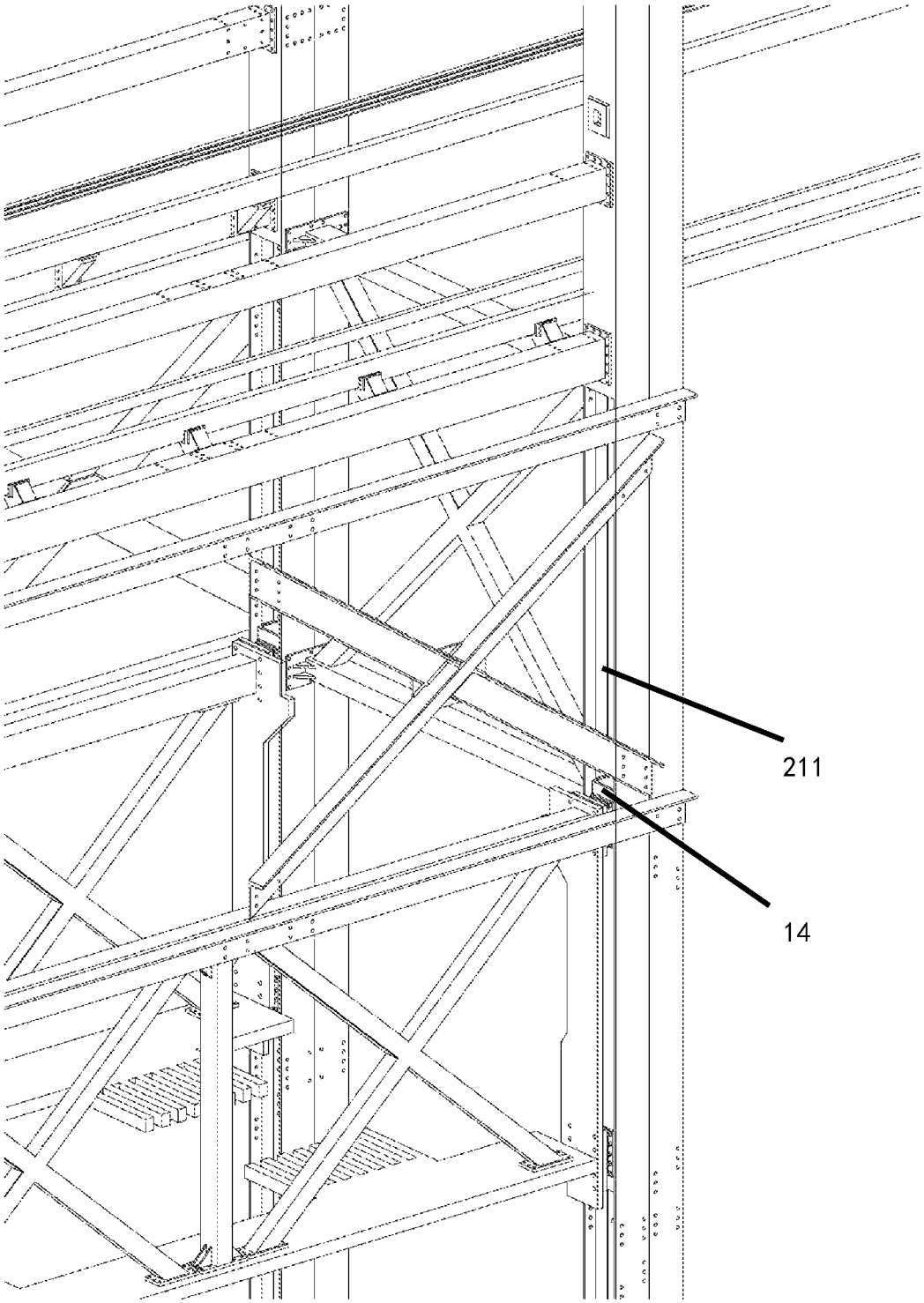
FIG. 8 shows a relationship diagram of a guide post and a guide groove.
Figure 19:
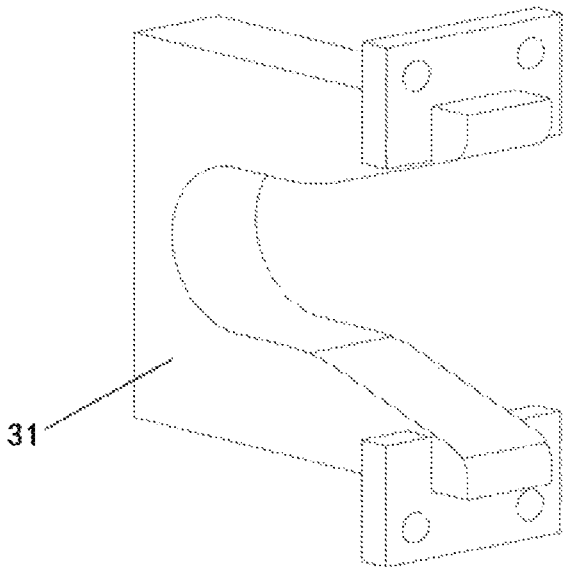
FIG. 19 shows a structural diagram of a forcible leveling female seat.
Figure 20:
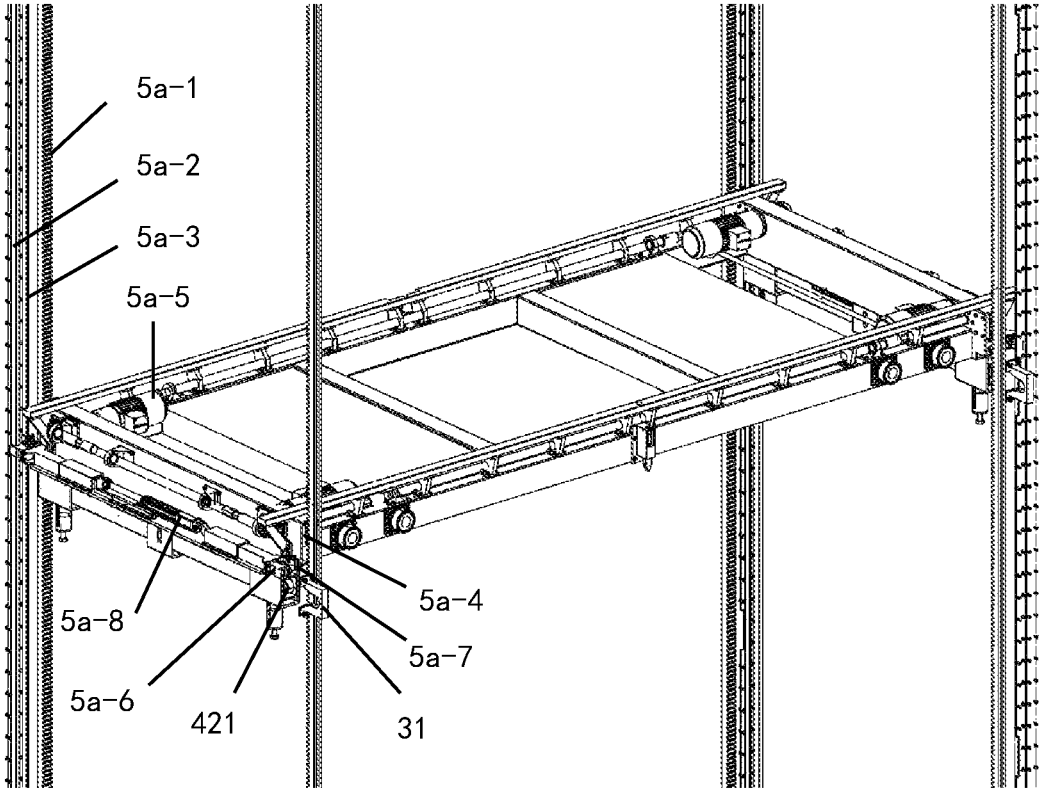
FIG. 20 shows a structural diagram that the supporting mechanism moves up and down in a shaft (first steel upright columns and second steel upright columns are hidden)
Figure 21:
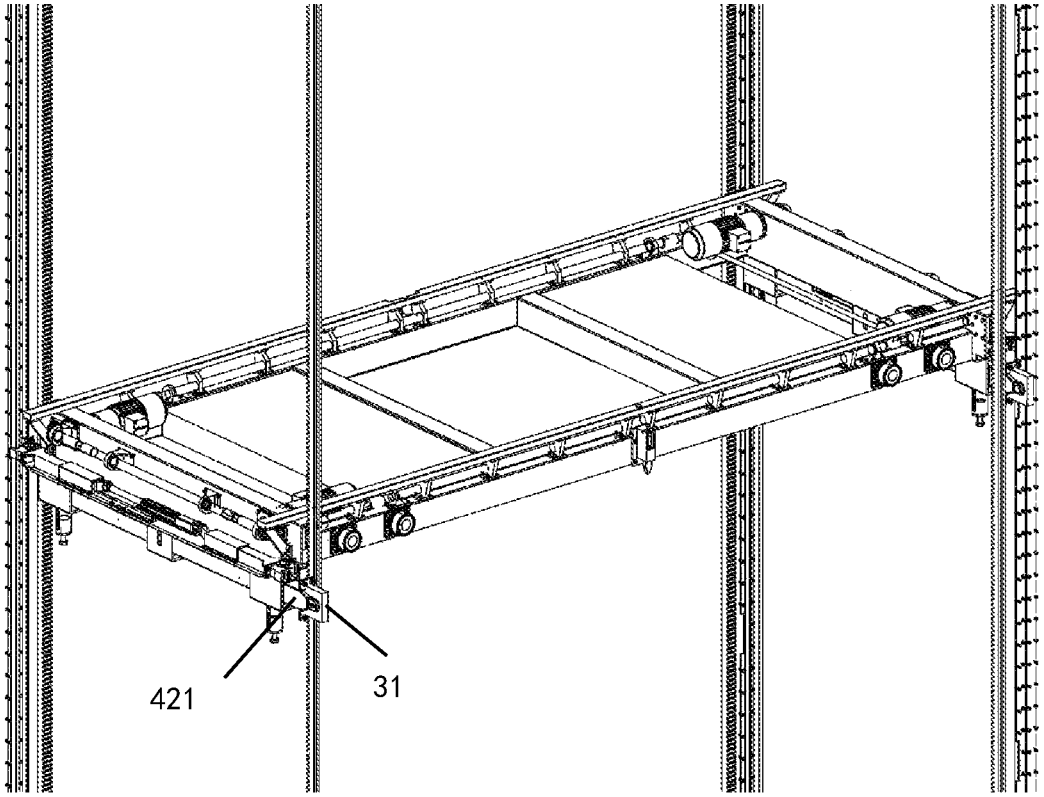
FIG. 21 shows a structural diagram that the supporting mechanism is precisely positioned when the supporting mechanism stays on the storage layer (the first steel upright columns and the second steel upright columns are hidden)
Figure 22:
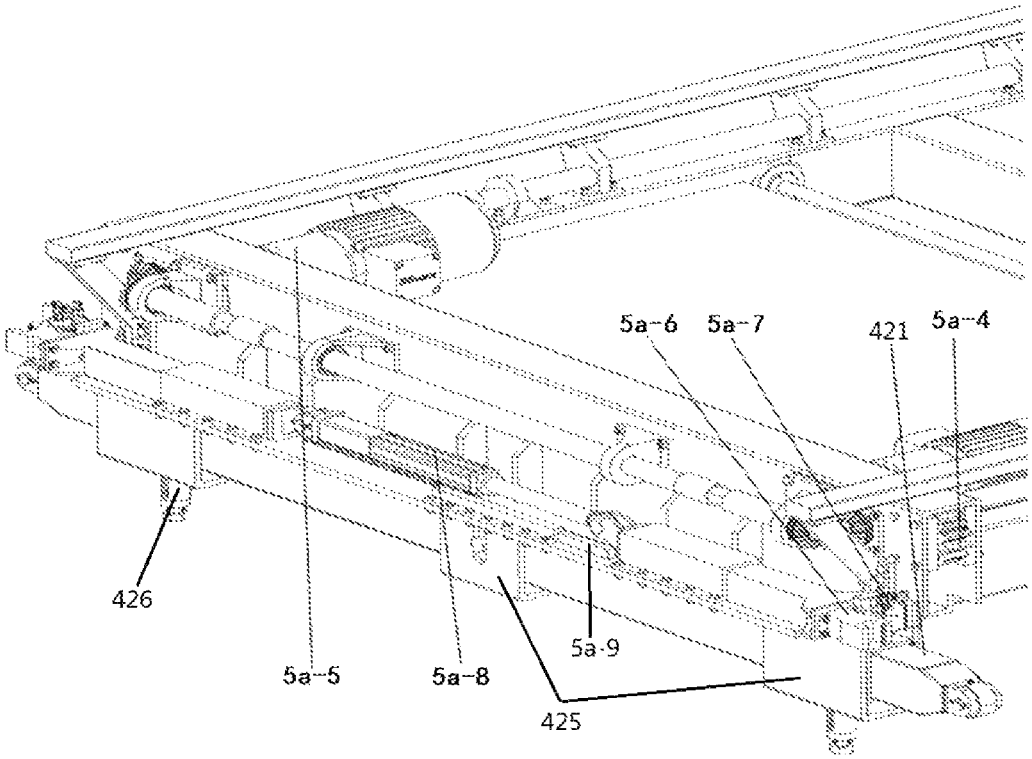
FIG. 22 shows a structural diagram of a part of devices of the supporting mechanism lifting apparatus and a forcible indirect precise leveling sub-system on the supporting mechanism.

When the supporting mechanism 4 stays on each storage layer 1, in order that the joining of the guide rails 41 and the first rails 12 or the fourth fixed rails 13 is more precise, as shown in FIGS. 16 and 18-22, forcible indirect precise leveling sub-systems are adopted. Each forcible indirect precise leveling sub-system comprises a forcible leveling device 42, a forcible leveling jacket 425, an adjusting device 426 and a forcible leveling female seat 31. Each forcible leveling device 42 is arranged on each of the side surfaces of the supporting mechanism 4; and each forcible leveling device 42 comprises two first telescopic tongues 421, two first synchronous racks 422, a first synchronous gear 423 and a first push rod 424 which is telescopic in the horizontal direction. The first telescopic tongues 421 are fixed at both ends of the first push rod 424 and are capable of stretching out and drawing back along with the first push rod 424; one end of each first synchronous rack 422 is fixedly connected with the first telescopic tongue 421; and the other ends of the first synchronous racks 422 are meshed with the first synchronous gear 423. The forcible leveling jackets 425 are rigidly connected with the supporting mechanism 4; the forcible leveling device 42 is arranged in the forcible leveling jackets 425; the adjusting devices 426 are arranged at the bottom of the forcible leveling jackets 425; and each adjusting device 426 comprises a supporting spring and an adjusting bolt and is used for enabling the forcible leveling device 42 to suspend at the central positions in the vertical direction of the forcible leveling jackets 425. Meanwhile, the forcible leveling female seats 31 are arranged on each layer of the shafts 3, and each forcible leveling female seat 31 is internally provided with a position sensor corresponding to the first telescopic tongues 421. As shown in FIG. 19, a trumpet opening for receiving the first telescopic tongues 421 is formed in the forcible leveling female seat 31. As shown in FIG. 20, when the supporting mechanism 4 moves up and down, the first telescopic tongues 421 draw back; and when the supporting mechanism 4 needs to stay on a storage layer 1, as shown in FIG. 21, the first telescopic tongues 421 are inserted into the forcible leveling female seats 31, so as to realize precise positioning. As shown in FIG. 3 and FIG. 6, the guide rails 41 are precisely joined with the first rails 12 or the fourth rails 13 through the third supplementary rails 28 on the first joining beams 27 and the fifth supplementary rails 30 on the second joining beams 29.

Specifically:

The forcible leveling jackets 425 are rigidly connected with the frame body of the supporting mechanism 4; the forcible leveling devices 42 are placed in the forcible leveling jackets 425 and are constrained by the forcible leveling jackets 425; the forcible leveling devices 42 (which are composed of the first telescopic tongues 421, the first synchronous racks 422 and the first electric push rods 424 (which are provided with telescopic initial point position sensors), wherein both ends of each first telescopic tongue 421 are telescopic synchronously) can only move up and down in the forcible leveling jackets 425; and the adjusting devices 426 (which are mainly composed of the supporting springs and the adjusting bolts) are used for enabling the forcible leveling devices 42 to suspend approximately (precision is not needed) at the center in the vertical height of the forcible leveling jackets 425. After the supporting mechanism 4 is configured to receive parking instructions of the position sensors and is parked (at the moment, the central height of the first telescopic tongues 421 of the forcible leveling device 42 is flush with the central height of the forcible leveling female seats 31 in the design, and an allowable error exists actually), the first telescopic tongues 421 of the forcible leveling devices 42 stretch out and are inserted into the forcible leveling female seats 31 on second steel upright columns 36 (the internally arranged position sensors are configured to send confirmation feedback signals to the system when the first telescopic tongues 421 are inserted in place). As the opening of the forcible leveling female seat 31 is in a trumpet shape, a certain error range is allowed, and the forcible leveling devices 42 are in a suspension state, so that the allowable error range is larger after addition of two terms, and the allowable error range is much larger than the parking position error caused by different loading weights of the supporting mechanism 4 (the supporting mechanism 4 is empty sometimes, is loaded with the self-delivering trolley 6 sometimes and is loaded with the self-delivering trolley 6 and the goods 8 sometimes). Therefore, a hard interference phenomenon does not occur. After the supporting mechanism 4 is configured to receive confirmation signals of insertion in place, which are sent by the position sensors in the forcible leveling female seats 31, a brake is released, so that the supporting mechanism 4 falls on the forcible leveling devices 42 that are arranged front and back; and at the moment, the guide rails 41 on the supporting mechanism 4 are flush with the third supplementary rails 28 on the first joining beam 27 between the first steel upright columns 21 and the first rails 12 or the fourth fixed rails 13 (the fifth supplementary rails 30 on the second joining beams 29 are flush with the first rails 12), so as to form a smooth continuous rail (as shown in FIG. 3) and realize precise leveling. The supporting mechanism 4 needs to move upwards a little distance when the supporting mechanism 4 is transformed from a leveling state into an upward or downward movement state, so that after the forcible leveling devices 42 are recovered to suspend, the first telescopic tongues 421 draw back in place, and the confirmation signals are sent to the system, the supporting mechanism 4 can move upwards or downwards.

Figure 23:
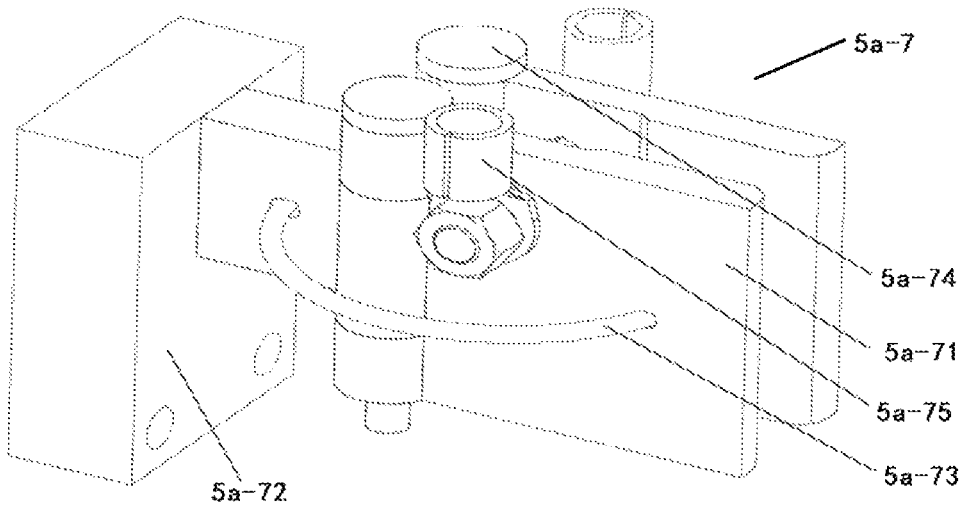
FIG. 23 shows a structural diagram of an electricity collection clip.

The supporting mechanism 4 moves up and down between every two adjacent layers by the supporting mechanism lifting apparatus 5*a*. As shown in FIGS. 2, 3, 5 and 20-22, the supporting mechanism lifting apparatus 5*a* comprises a plurality of vertical racks 5*a*-1, a plurality of vertical guide rails 5*a*-2, a plurality of trolley conductors 5*a*-3, a plurality of movement gears 5*a*-4 meshed with the vertical racks 5*a*-1, first motor 5*a*-5, a plurality of guide shoes 5*a*-6, a plurality of electricity collection clips 5*a*-7, a plurality of fourth push rods 5*a*-8 which are telescopic and are arranged horizontally and a plurality of third synchronous racks 5*a*-9. Each shaft 3 comprises four second steel upright columns 36 for supporting the supporting mechanisms 4 to move up and down, and the second steel upright columns 36 are vertically arranged at four corners of the shaft 3. The vertical racks 5*a*-1, the vertical guide rails 5*a*-2 and the trolley conductors 5*a*-3 are all vertically fixed on the second steel upright columns 36 of the shaft 3. The movement gears 5*a*-4, the first motor 5*a*-5, the guide shoes 5*a*-6, the electricity collection clips 5*a*-7, the fourth push rods 5*a*-8 and the third synchronous racks 5*a*-9 are all arranged on the supporting mechanism 4. The first motor 5*a*-5 is used for providing power of rotation for the movement gears 5*a*-4 and driving the supporting mechanism 4 to move up and down. The guide shoes 5*a*-6 are fixed at both ends of each fourth push rod 5*a*-8; and the guide shoes 5*a*-6 are matched with the vertical guide rails 5*a*-2 when the guide shoes 5*a*-6 stretch out along with the fourth push rod 5*a*-8, so that the supporting mechanism 4 can move up and down along the vertical guide rails 5*a*-2. The electricity collection clips 5*a*-7 are fixed at both ends of the fourth push rod 5*a*-8; and the electricity collection clips 5*a*-7 are in touch with the trolley conductors 5*a*-3 to obtain electricity when the electricity collection clips 5*a*-7 stretch out along with the fourth push rod 5*a*-8. The third synchronous racks 5*a*-9 are used for enabling the guide shoes 5*a*-6 and the electricity collection clips 5*a*-7 to be telescopic synchronously. As shown in FIG. 23, the electricity collection clip 5*a*-7 comprises two electricity collection clip plates 5*a*-71, an insulated base 5*a*-72 arranged on the outer side of the electricity collection clip plates 5*a*-71, a closed spring 5*a*-73, two fourth pins 5*a*-74 and wiring lugs 5*a*-75 arranged at the upper parts of the fourth pins 5*a*-74. The two fourth pins 5*a*-74 are respectively fixed on the insulated base 5*a*-72 and are connected with the electricity collection clip plates 5*a*-71, so that the electricity collection clip plates 5*a*-71 is capable of rotating by taking the fourth pins 5*a*-74 as shafts. The closed spring 5*a*-73 is connected with the insulated base 5*a*-72 and the electricity collection clip plates 5*a*-71. When the electricity collection clips 5*a*-7 are used for obtaining electricity, the trolley conductors 5a-3 are located between the two electricity collection clip plates 5a-71.

Figure 24:
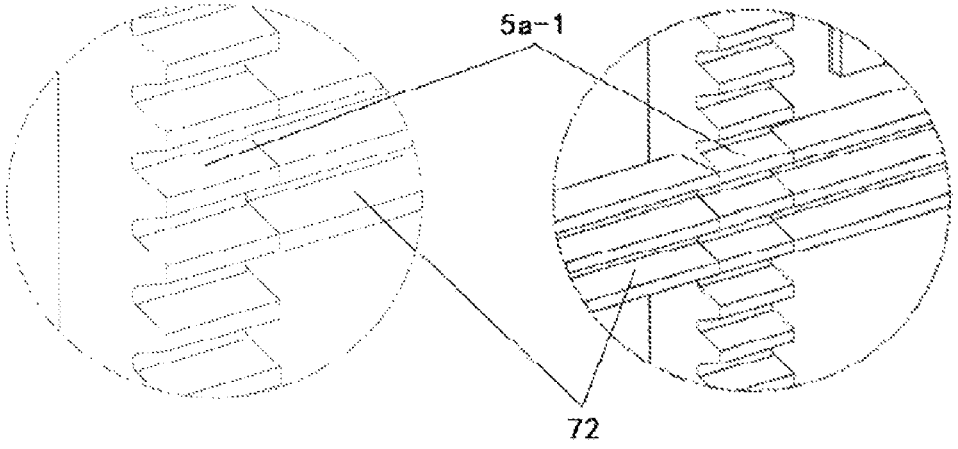
FIG. 24 shows a structural diagram of a gear guide plate.

As shown in FIGS. 1-3 and 20-22, when the supporting mechanism 4 is driven to move to the supporting mechanism horizontal movement layer 7 on the lowermost layer by the supporting mechanism lifting apparatus 5a, the fourth push rods 5a-8 draw back, so that the guide shoes 5a-6 are separated from the vertical guide rails 5a-2, the electricity collection clips 5a-7 are separated from the trolley conductors 5a-3, and the supporting mechanism 4 can move horizontally on the supporting mechanism horizontal movement layer 7. The supporting mechanism horizontal movement layer 7 is provided with third rails 73 for horizontal movement of the supporting mechanism 4, and the third rails 73 extend to the shaft 3, so that the supporting mechanism 4 can move on the third rails 73. Fifth calibrating and positioning devices are arranged on the third rails 73 on the lowermost layer of the shaft 3; and the fifth calibrating and positioning devices are third positioning holes and correspond to the fourth calibrating and positioning devices 45 on the supporting mechanism 4. Each fifth calibrating and positioning device comprises the third positioning hole, into which the third telescopic tongue can be inserted. As shown in FIG. 2 and FIG. 24, horizontal gear guide plates 72 are arranged on the supporting mechanism horizontal movement layer 7 on the lowermost layer; extension movement gear guide plates 35 are arranged on the shaft 3; the gear guide plates 72 and the extension movement gear guide plates 35 are both have the same tooth shape as that of the vertical racks 5a-1 and are in alignment with the vertical racks 5a-1, so that the movement gears 5a-4 can horizontally slide on the gear guide plates 72 and the extension movement gear guide plates 35, and the movement gears 5a-4 keep meshing with the corresponding vertical racks 5a-1 when the supporting mechanism 4 horizontally moves from the shaft 3 to the other shaft 3.

Figure 25:
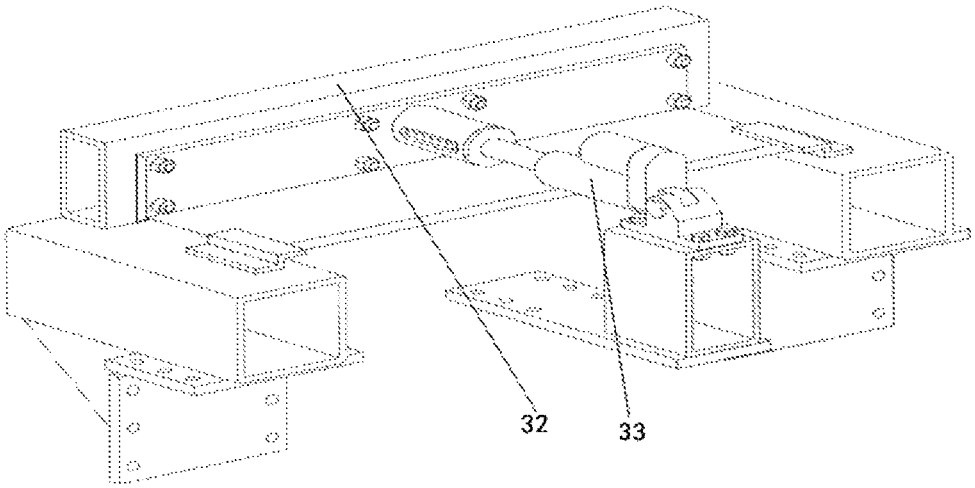
FIG. 25 shows a structural diagram of a first supplementary rail and a fifth push rod.
Figure 26:
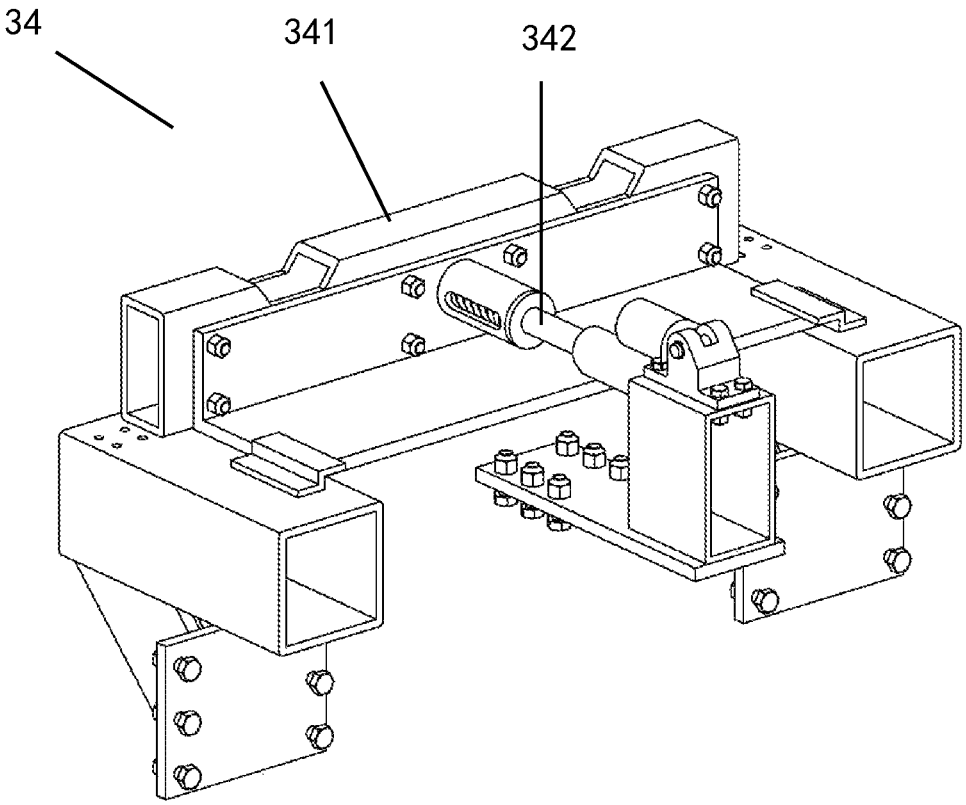
FIG. 26 shows a structural diagram of an overhaul position supplementary rail device.

When the supporting mechanism 4 is driven to be about to move to the supporting mechanism horizontal movement layer 7 on the uppermost layer by the supporting mechanism lifting apparatus 5a, the supporting mechanism 4 is about to horizontally move on the supporting mechanism horizontal movement layer 7. As shown in FIG. 2 and FIG. 25, the supporting mechanism horizontal movement layer 7 is provided with second rails 71 for horizontal movement of the supporting mechanism, and the shaft 3 is provided with first supplementary rails 32, fifth push rods 33 which are arranged horizontally and are telescopic and overhaul position supplementary rail devices 34 on the layer. The fifth push rods 33 are vertically connected with the first supplementary rails 32, and the first supplementary rails 32 are parallel to the second rails 71 on the uppermost layer and can be connected with or separated from the second rails 71 on the uppermost layer along with the horizontal movement of the fifth push rods 33. When the first supplementary rails 32 are connected with the second rails 71 on the uppermost layer, the supporting mechanism 4 is capable of running from the first supplementary rails 32 onto the second rails 71 or run from the second rails 71 onto the first supplementary rails 32. Each first supplementary rail 32 is provided with a sixth calibrating and positioning device, and the sixth calibrating and positioning devices are fourth positioning holes and correspond to the fourth calibrating and positioning devices 45 on the supporting mechanism 4. As shown in FIG. 2 and FIG. 6, the overhaul position supplementary rail device 34 is higher than the first supplementary rail 32, and the height difference of the overhaul position supplementary rail device 34 and the first supplementary rail 32 is greater than the height of the supporting mechanism 4, so that the overhaul position supplementary rail device 34 does not affect the cycle running of the supporting mechanism 4. The overhaul position supplementary rail device 34 comprises sixth supplementary rails 341 and sixth push rods 342 which are arranged horizontally and are telescopic; the sixth push rod 342 is vertically connected with the sixth supplementary rail 341; and the sixth supplementary rails 341 are parallel to the first supplementary rails 32 and can be separated to both sides of the shaft 3 or draw back along with the horizontal movement of the sixth push rods 342. A plurality of notches are formed in the sixth supplementary rails 341, so that the supporting mechanism 4 is fixed on the sixth supplementary rails 341. When the supporting mechanism 4 breaks down and needs to be maintained, the sixth supplementary rails 341 stretch to both sides of the shaft 3, and the supporting mechanism 4 ascends in the shaft 3 and is higher than the overhaul position supplementary rail devices 34. The sixth supplementary rails 341 of the overhaul position supplementary rail devices 34 are driven to move into the shaft 3 to the position under the supporting mechanism 4 by the sixth push rods 342, the supporting mechanism 4 moves downwards onto the sixth supplementary rails 341, and the second running wheels 43 of the supporting mechanism 4 are clamped with the notches in the sixth supplementary rails 341, so that the supporting mechanism 4 is fixed on the sixth supplementary rails for overhauling. Horizontal gear guide plates 72 are arranged on the supporting mechanism horizontal movement layer 7 on the uppermost layer, extension movement gear guide plates 35 are arranged on the shaft 3, and the gear guide plates 72 and the extension movement gear guide plates 35 are both have the same tooth shape as that of the vertical racks 5a-1 and are in alignment with the vertical racks 5a-1, so that the movement gears 5a-4 can horizontally slide on the gear guide plates 72 and the extension movement gear guide plates 35.

In order to improve the storage and pick-up efficiency of the goods 8, the supporting mechanism 4 in the shaft 3 at one end only moves upwards; the supporting mechanism 4 in the shaft 3 at the other end only moves downwards; the supporting mechanism 4 in the supporting mechanism horizontal movement layer 7 on the uppermost layer only moves horizontally to one direction; the supporting mechanism 4 in the supporting mechanism horizontal movement layer 7 on the lowermost layer only moves to the other direction; and therefore, a circular path is formed, so that the supporting mechanism 4 can do unidirectional movement clockwise or anticlockwise.

The goods 8 in FIG. 1 enter a warehouse from the left bottom corner and move out of the warehouse from the right bottom corner; the circular path of the supporting mechanism 4 is that: along the anticlockwise direction, the supporting mechanisms 4 moves from the supporting mechanism horizontal movement layer 7 on the lowermost layer to the shaft 3 on the right side, then moves upwards from the shaft 3 on the right side to the supporting mechanism horizontal movement layer 7 on the uppermost layer, moves horizontally to the uppermost layer of the shaft 3 on the left side and finally moves downwards from the shaft 3 on the left side to the lowermost layer.

The principle of storing the goods is described as follows:

(1) The goods 8 are transported to the position above the supporting mechanism 4 loaded with the self-delivering trolley 6; and at the moment, the goods 8 are located on the lowermost layer of the shaft 3 on the left side in FIG. 1 and right above the second supporting component 63, and the guide shoes 5*a*-6 and the electricity collection clips 5*a*-7 draw back.

(2) The supporting mechanism 4 moves horizontally forwards (the supporting mechanism 4 moves rightwards in FIG. 1) to transport the goods 8 to the lowermost layer of the shaft 3 on the right side.

(3) The fourth calibrating and positioning devices 45 of the supporting mechanism 4 and the fifth calibrating and positioning devices on the third rails 73 are matched for calibrating and positioning (so that the supporting mechanism 4 is located at the center of the lowermost layer of the shaft 3).

(4) The fourth push rods 5*a*-8 extend, the guide shoes 5*a*-6 stretch out onto the vertical guide rails 5*a*-2, and the electricity collection clips 5*a*-7 stretch out to be in touch with the trolley conductors 5*a*-3, so as to obtain electricity for the first motor 5*a*-5; and the first motor 5*a*-5 is configured to obtain electricity, and after instructions of the control signals are received, the first motor 5*a*-5 is configured to drive the movement gears 5*a*-4 to rotate to be meshed with the vertical racks 5*a*-1, so as to drive the supporting mechanism 4 to move upwards.

(5) The supporting mechanism 4 runs to the designated storage layer 1, the movement gears 5*a*-4 stop rotating, and the first telescopic tongues 421 stretch out and are inserted into the trumpet openings of the forcible leveling female seats 31, so that the supporting mechanism 4 is precisely positioned, and the guide rails 41 are precisely connected with the first rail 12.

(6) The third calibrating and positioning devices 65 of the self-delivering trolley 6 and the second calibrating and positioning devices on the first rail 12 are matched for calibrating and positioning, the second supporting component 63 ascends to be higher than the first supporting component 111, and the self-delivering trolley 6 moves leftwards to the designated storage shelves 11; and if other goods 8 are in front of the self-delivering trolley 6, the lifting hooks corresponding to the storage shelves, on which the goods 8 are located, are opened, other lifting hooks draw back, and the lifting rods 23 move upwards and drive the goods 8 and all storage shelves 11 on the upper layers of the goods 8 to move upwards. At the same time, the supporting mechanism 4 moves upwards, passes through the supporting mechanism horizontal movement layer 7 on the uppermost layer and moves into the shaft 3 on the left side.

(7) The self-delivering trolley 6 reaches the designated storage shelves 11, the second supporting component 63 descends to be lower than the first supporting component 111, and the goods 8 are supported by the first supporting component 111, so as to complete the storage of the goods 8.

(8) The self-delivering trolley 6 continues to move leftwards onto the supporting mechanism 4 in the shaft 3 on the left side and waits for the storage and pick-up of the next goods 8.

The principle of picking up the goods is described as follows:

(1) The supporting mechanism 4 is used for transporting the empty self-delivering trolley 6 to the designated storage layer 1 of the shaft 3 on the right side.

(2) The self-delivering trolley 6 runs from right to left to the position right under the designated storage shelves 11, and at the moment, the second supporting component of the self-delivering trolley 6 is lower than the first supporting component 111.

(3) The third calibrating and positioning devices 65 of the self-delivering trolley 6 and the first calibrating and positioning devices on the first rail 12 are matched for calibrating and positioning, the second supporting component 63 ascends to be higher than the first supporting component 111, and the goods 8 are supported by the second supporting component 63.

(4) The second supporting component 63 keeps the height unchanged, and the self-delivering trolley 6 runs leftwards; and if other goods 8 are in front of the self-delivering trolley 6, the lifting hooks corresponding to the storage shelves 11 of the goods 8 stretch out, other lifting hooks draw back, and the lifting rods 23 move upwards and drive the goods 8 and all storage shelves 11 on the upper layers of the goods 8 to move upwards.

(5) In the shaft 3 on the left side, the supporting mechanism 4 moves downwards to the designated storage layer 1, the movement gears 5*a*-4 stop rotating, and the first telescopic tongues 421 stretch out and are inserted into the trumpet openings of the forcible leveling female seats 31, so that the supporting mechanism 4 is precisely positioned, and the guide rails 41 are precisely connected with the first rail 12; and the self-delivering trolley 6 runs onto the guide rails 41 of the supporting mechanism 4.

(6) The third calibrating and positioning devices 65 of the self-delivering trolley 6 and the first calibrating and positioning devices 44 of the supporting mechanism are matched for calibrating and positioning, and the second supporting component 63 descends.

(7) The supporting mechanism 4 moves upwards a little distance and then stops, so that the forcible leveling devices 42 are recovered to suspend, then the first telescopic tongues 421 draw back in place, and confirmation signals are sent to the control system; next, the supporting mechanism 4 moves downwards to the lowermost layer of the shaft 3 on the left side; the fourth push rods 5*a*-8 draw back; the guide shoes 5*a*-6 and the electricity collection clips 5*a*-7 draw back; and the supporting mechanism 4 moves rightwards to the lowermost layer of the shaft 3 on the right side, and the goods 8 are unloaded.

The principle of cycle running of the supporting mechanism 4 is described as follows:

(1) The initial position of the supporting mechanism 4 is the lowermost layer of the shaft 3 on the left side; at the moment, the guide shoes 5*a*-6 and the electricity collection clips 5*a*-7 draw back, and the supporting mechanism 4 moves horizontally rightwards to the lowermost layer of the shaft 3 on the right side; and the movement gears 5*a*-4 of the supporting mechanism 4 keep meshing with the gear guide plates 72 in the whole process.

(2) The fourth calibrating and positioning devices 45 and the fifth calibrating and positioning devices are matched for calibrating and positioning, the guide shoes 5*a*-6 stretch out to the vertical guide rails 5*a*-2, and the electricity collection clips 5*a*-7 stretch out to the trolley conductors 5*a*-3.

(3) The movement gears 5*a*-4 are driven to move upwards by the first motor 5*a*-5; and when the supporting mechanism 4 needs to stay on a storage layer 1 for storing the goods 8, the first motor 5*a*-5 brakes and stops rotating, and the first telescopic tongues 421 stretch into the trumpet openings of the forcible leveling female seats 31 on the layer, so as to realize forcible indirect precise positioning of the supporting mechanism 4 on the layer.

(4) After the self-delivering trolley 6 and the goods 8 leave the supporting mechanism 4, the supporting mechanism 4 ascends a little distance and then stops, so that the forcible leveling devices 42 are recovered to suspend, the first telescopic tongues 421 draw back in place, and the confirmation signals are sent to the control system; and next, the movement gears 5*a*-4 are driven to move upwards to be higher than the first supplementary rails 32 by the first motor 5*a*-5, and at the moment, the first supplementary rails 32 are driven to horizontally open to both sides of the supporting mechanism 4 by the fifth push rods 33, so that the supporting mechanism 4 can move upwards.

(5) After the supporting mechanism moves upwards to be higher than the supporting mechanism horizontal movement layer 7 on the uppermost layer, the first supplementary rails 32 are pushed to move horizontally inwards by the fifth push rods 33 until the first supplementary rails 32 are connected with the second rails 71 of the supporting mechanism horizontal movement layer 7 on the uppermost layer.

(6) The brake is released by the first motor 5*a*-5, so that the movement gears 5*a*-4 move downwards until the second running wheels 43 of the supporting mechanism 4 are in touch with the first supplementary rails 32; and the supporting mechanism 4 is supported by the first supplementary rails 32.

(7) The guide shoes 5*a*-6 and the electricity collection clips 5*a*-7 draw back, and the supporting mechanism 4 moves leftwards along the second rails 71 to the uppermost layer of the shaft 3 on the left side; and the movement gears 5*a*-4 of the supporting mechanism 4 keep meshing with the gear guide plates 72 in the whole process, and at the moment, the first supplementary rails 32 on the uppermost layer of the shaft 3 on the left side are connected with the second rails 71.

(8) The fourth calibrating and positioning devices 45 of the supporting mechanism 4 and the sixth calibrating and positioning devices are matched for calibrating and positioning, the guide shoes 5*a*-6 stretch out to the vertical guide rails 5*a*-2, and the electricity collection clips 5*a*-7 stretch out to the trolley conductors 5*a*-3.

(9) The movement gears 5*a*-4 are driven to move upwards by the first motor 5*a*-5 until the supporting mechanism 4 leaves the first supplementary rails 32.

(10) The first supplementary rails 32 are driven to horizontally open to both sides of the supporting mechanism 4 by the fifth push rods 33, so that the supporting mechanism 4 can move downwards.

(11) The movement gears 5*a*-4 are driven to move downwards by the first motor 5*a*-5; and when the supporting mechanism 4 needs to stay on a storage layer 1 for picking up the goods 8 or catching the empty self-delivering trolley 6, the first motor 5*a*-5 brake and stop rotating, and the first telescopic tongues 421 stretch into the trumpet openings of the forcible leveling female seats 31 on the layer, so as to realize forcible indirect precise positioning of the supporting mechanism 4 on the layer.

(12) The supporting mechanism 4 needs to move upwards a short distance when the supporting mechanism 4 is about to leave the leveling position, so that the forcible leveling devices 42 are not pressed and are recovered to a suspension state; the first telescopic tongues 421 draw back in place, and then the confirmation signals are sent to the control system; and next, the movement gears 5*a*-4 are driven to move downwards onto the third rails 73 on the lowermost layer of the shaft 3 on the left side by the first motor 5*a*-5.

(13) The supporting mechanism 4 is supported by the third rails 73, and the guide shoes 5*a*-6 and the electricity collection clips 5*a*-7 draw back.

(14) If the self-delivering trolley 6 is empty at the moment, the self-delivering trolley 6 needs to wait for loading of the goods 8 that need to be stored; and if the self-delivering trolley 6 is loaded with the goods 8 that need to be picked up, the supporting mechanism 4 moves horizontally rightwards to the lowermost layer of the shaft 3 on the right side, and the goods 8 are unloaded.

Through the major cycle of the supporting mechanism 4 and the minor cycle of the self-delivering trolley 6, the goods 8 are quickly and efficiently stored and picked up in rush hours of storage and pick-up of the goods 8.

Figure 27:
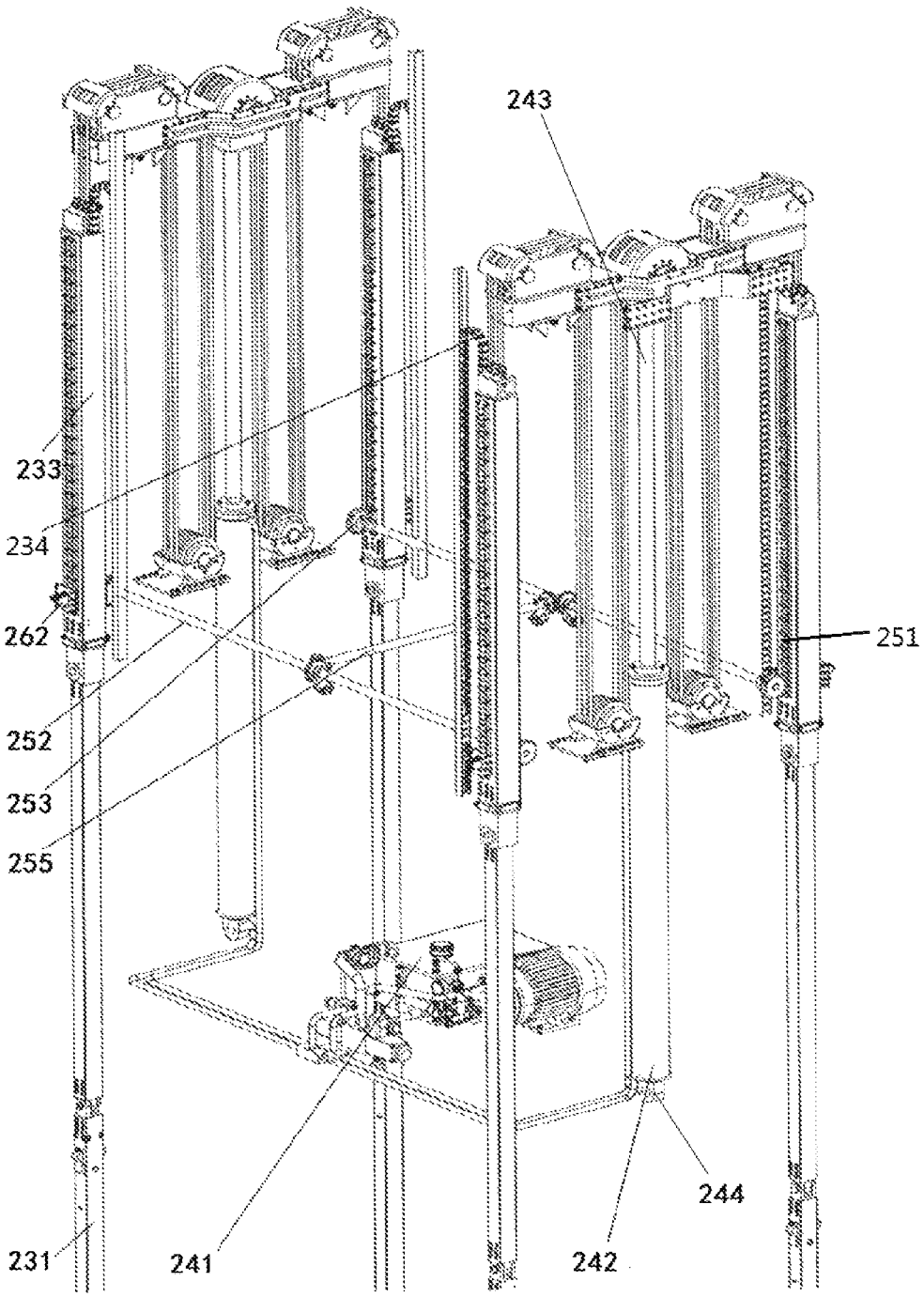
FIG. 27 shows a structural relationship diagram of a first power mechanism and lifting rods in a second implementation manner.

According to a second specific implementation manner of the present disclosure, the present disclosure provides a single-row multilayer storage warehouse system with vertical avoidance. The structure of the system is basically the same as that in the first specific implementation manner. The differences are that: as shown in FIG. 27, hydraulic cylinder telescopic rods 243 and hydraulic cylinders 242 of a first power mechanism 24 are all arranged outside lifting rods 23; and the hydraulic cylinders 242 with greater power are adopted to cope with heavier goods 8.

According to a third specific implementation manner of the present disclosure, the present disclosure provides a single-row multilayer storage warehouse system with vertical avoidance. The structure of the system is basically the same as that in the first specific implementation manner. The differences are that: the system also comprises a program control center and a plurality of sensors; the program control center is connected with the sensors, supporting mechanisms 4, self-delivering trolleys 6, storage shelf lifting apparatus 2 and supporting mechanism lifting apparatus 5*a* in a communication manner and is configured to grasp the conditions that whether storage shelves 11 ascend and whether goods 8 are on first supporting component 111 and position and state information of the supporting mechanisms 4 and the self-delivering trolleys 6 in real time. The program control center is also configured to detect the height of all storage shelves 11 after all the storage shelves 11 ascend and descend each time; and if the error range is exceeded, the program execution stops, and corresponding fault codes are sent. The sensors are arranged in calibrating and positioning devices and are used for ensuring successful calibrating and positioning; the sensors are configured to transmit signals to the program control center for performing next commands. Each sensor is also arranged in each lifting hook and is used for identifying that whether the lifting hook is opened or closed completely; and signals of the sensors are transmitted to the program control center.

Figure 28:
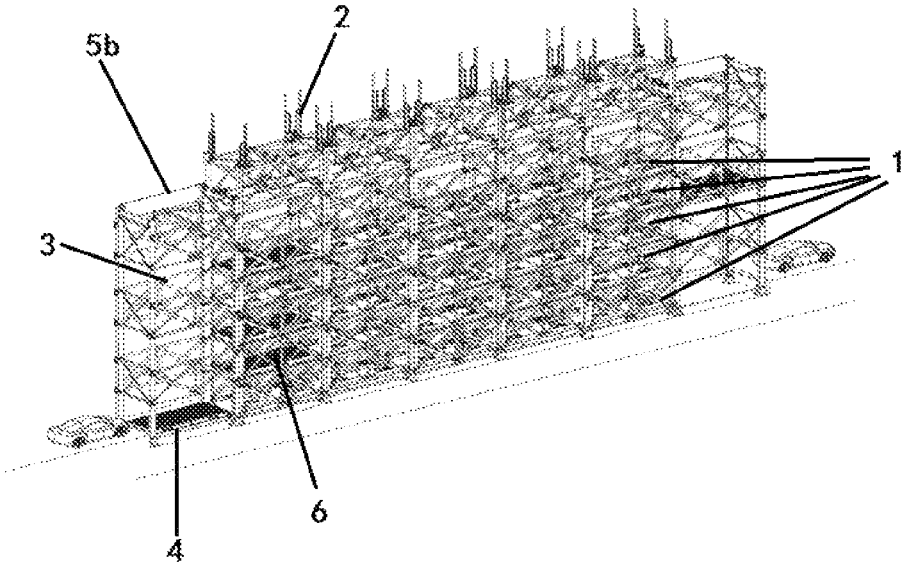
FIG. 28 shows a structural diagram of a storage warehouse system in a fourth implementation manner.
Figure 29:
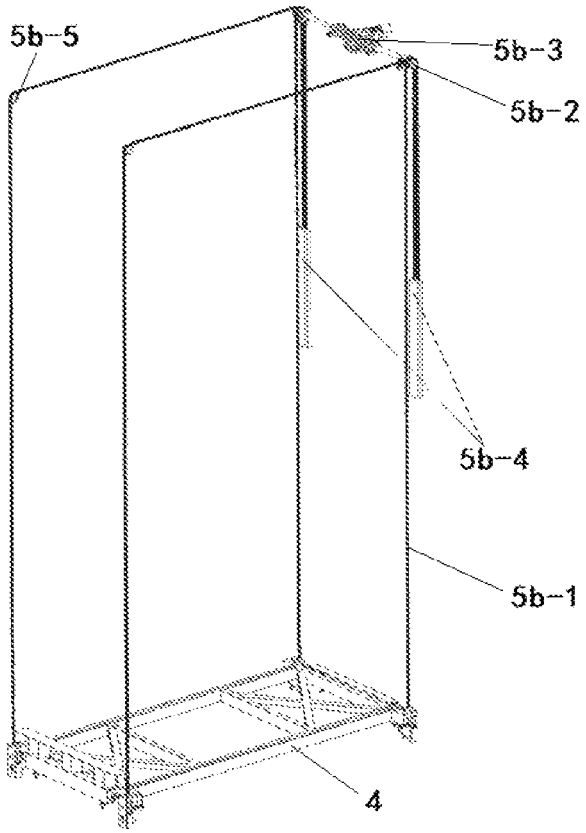
FIG. 29 shows a structural diagram of a supporting mechanism lifting apparatus in the fourth implementation manner.

According to a fourth specific implementation manner of the present disclosure, the present disclosure provides a single-row multilayer storage warehouse system with vertical avoidance. The structure of the system is basically the same as that in the first specific implementation manner. As shown in FIGS. 28-29, the differences are that:

(1) The system is not provided with supporting mechanism horizontal movement layers 7 on the uppermost layer and the lowermost layer.

(2) The uppermost layer and the lowermost layer of each shaft 3 are not provided with corresponding first supplementary rails 32 and corresponding third rails 73.

(3) Supporting mechanisms 4 do not need to run horizontally, therefore, the supporting mechanisms 4 are not provided with second running wheels 43 and fourth calibrating and positioning devices 45 on both sides, and one supporting mechanism 4 is arranged in each shaft 3.

(4) Supporting mechanism lifting apparatus 5*b* adopts a chain lifting type; and each supporting mechanism lifting apparatus 5*b* comprises four chains 5*b*-1, double-row lifting chain wheels 5*b*-2, a second motor 5*b*-3, weights 5*b*-4 and bend chain wheels 5*b*-5. The second motor 5*b*-3 is connected with the double-row lifting chain wheels **5*b*-2 and is used for driving the double-row lifting chain wheels 5*b*-2 to rotate. The four chains 5*b*-1 are arranged on the double-row lifting chain wheels 5*b*-2 and move up and down along with the rotation of the double-row lifting chain wheels 5*b*-2; and in addition, two of the chains 5*b*-1 are arranged on the bend chain wheels 5*b*-5, and the directions of the two chains 5*b*-1 are changed by the bend chain wheels 5*b*-5. One end of each chain 5*b*-1 is connected with the weight 5*b*-4, and the other ends of the chains 5*b*-1 are connected with the supporting mechanism 4**.

(5) Goods 8 of the system enter the storage warehouse system from the lowermost layer of the shaft 3 on the left side and leave the storage warehouse system from the lowermost layer of the shaft 3 on the right side.

Figure 30:
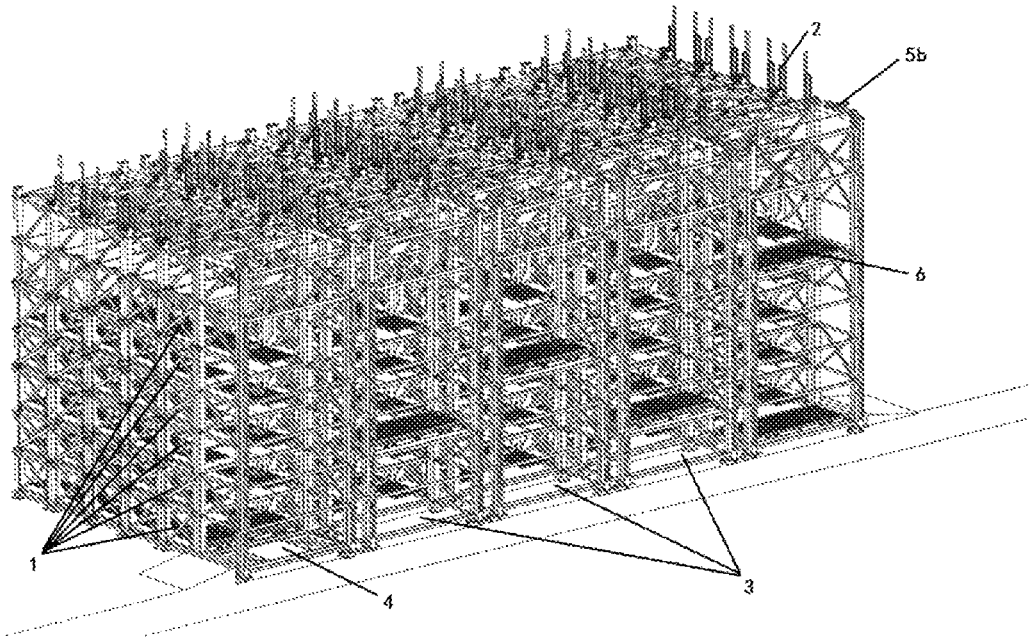
FIG. 30 shows a structural diagram of a storage warehouse system in a fifth implementation manner (the other half part of storage warehouses are not shown)
Figure 31:
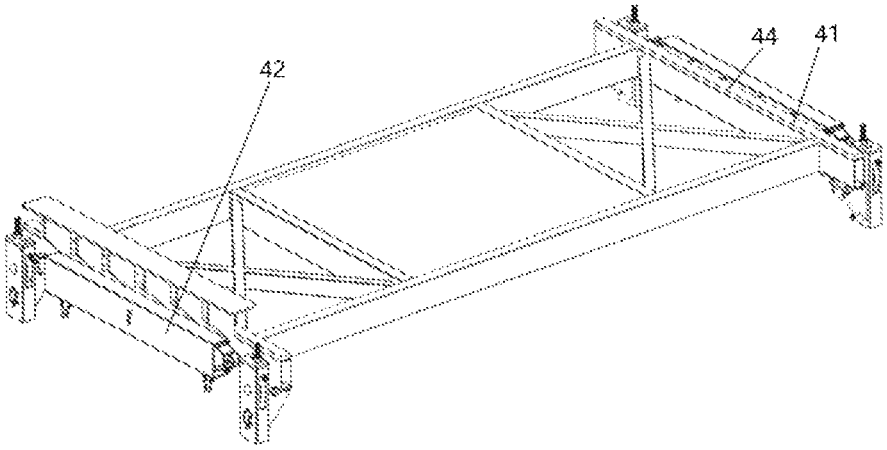
FIG. 31 shows a structural diagram of a supporting mechanism in the fifth implementation manner.
Figure 32:
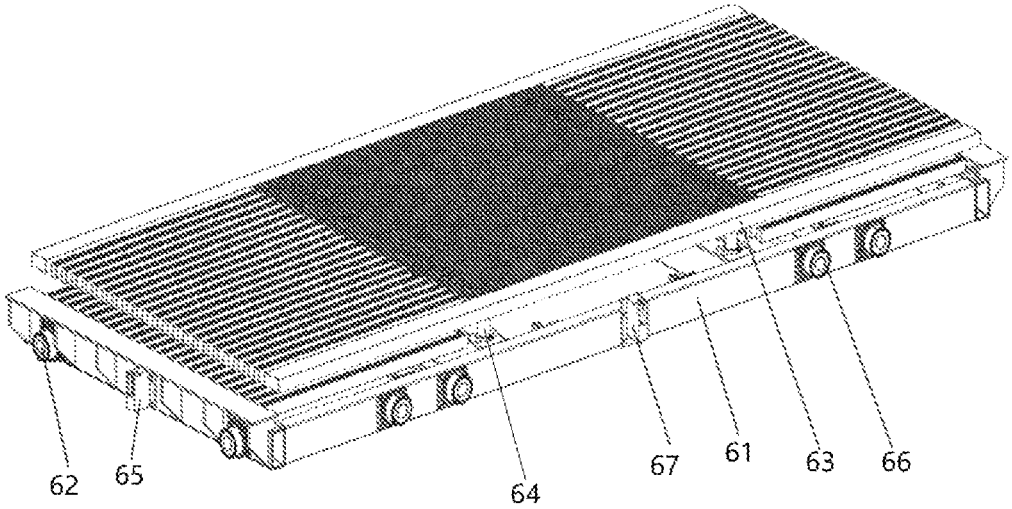
FIG. 32 shows a structural diagram of a self-delivering trolley in the fifth implementation manner.
Figure 33:
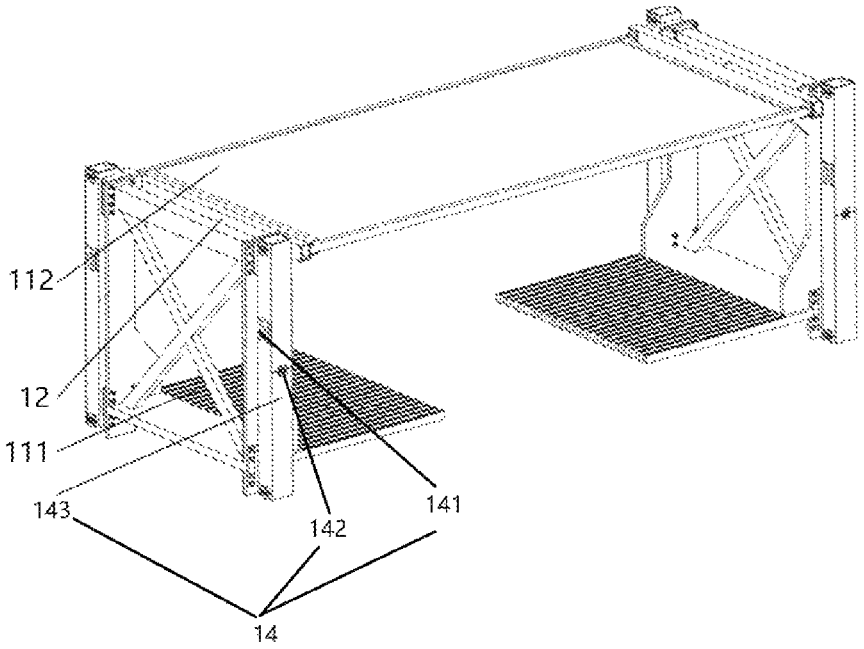
FIG. 33 shows a structural diagram of a storage shelf in the fifth implementation manner.
Figure 34:
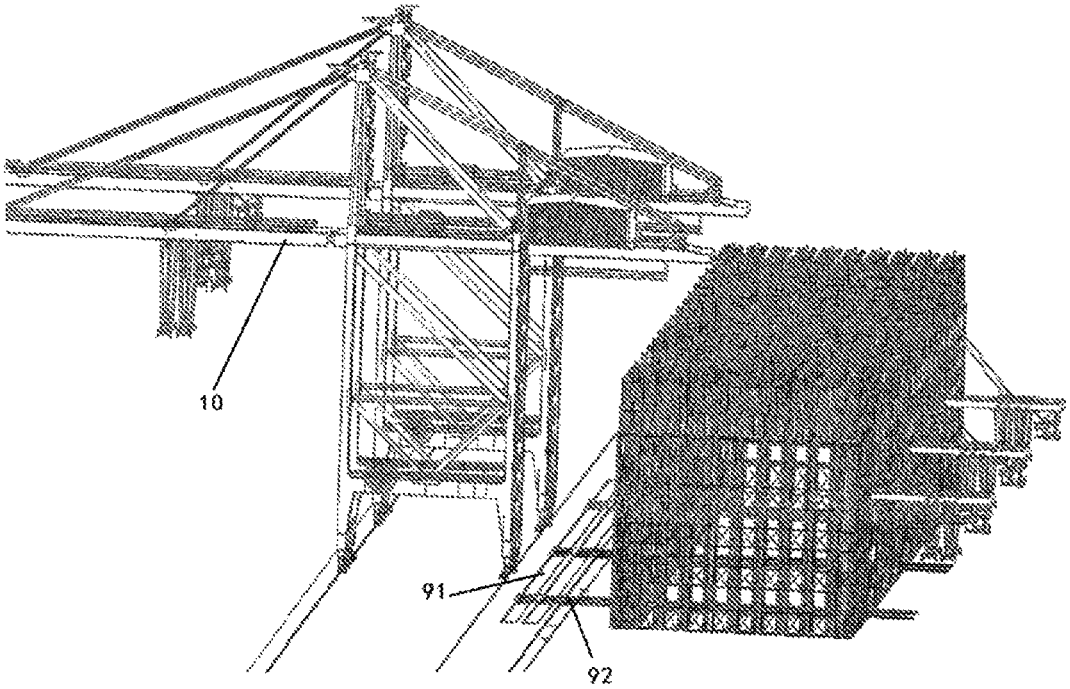
FIG. 34 shows an axonometric drawing of a port wharf in a sixth implementation manner.

According to a fifth specific implementation manner of the present disclosure, the present disclosure provides a multirow multilayer storage warehouse system with vertical avoidance. The structure of the system is basically the same as that in the fourth specific implementation manner. As shown in FIGS. 30-33, the differences are that:

(1) The storage warehouse system comprises ten single-row multilayer storage warehouse systems, wherein in FIG. 30, each storage layer 1 is provided with twenty-five groups of storage shelves; shafts 3 are arranged in the middle of the storage warehouse system; and five single-row multilayer structures are arranged on one side of the shafts 3, storage shelves on the other side are not shown, and five single-row multilayer structures are arranged on the other side of the shafts 3.

(2) Each layer of storage shelves of the storage warehouse system are in a structure that the long edges of the storage shelves are connected to form a single-row storage layer 1.

(3) Fourth supplementary rails are arranged on the shafts 3 on the lowermost layer, and the fourth supplementary rails are used for running of self-delivering trolleys 6.

(4) Guide rails 41 of each supporting mechanism 4 are arranged on the short edges of the supporting mechanism 4. The supporting mechanism 4 can move downwards to be lower than the fourth supplementary rails, so that the self-delivering trolley 6 on the supporting mechanism 4 is switched onto the fourth supplementary rails.

(5) The self-delivering trolley 6 is also provided with third running wheels 66 and seventh calibrating and positioning devices 67 on the other two sides of first running wheels 62, the seventh calibrating and positioning devices 67 correspond to fifth calibrating and positioning devices arranged on the long edges of the supporting mechanism 4, and the third running wheels 66 can move horizontally between two adjacent shafts 3 through the fourth supplementary rails.

According to a sixth specific implementation manner of the present disclosure, the present disclosure provides a multirow multilayer storage warehouse system with vertical avoidance. The structure of the system is basically the same as that in the fourth specific implementation manner. As shown in FIGS. 34-40, the differences are that:

(1) The storage warehouse system is used for loading and unloading of containers at a wharf.

(2) Three shafts 3 are arranged in the middle of the storage warehouse system.

(3) The storage warehouse system comprises ten single-row multilayer storage warehouse systems.

Figure 39:
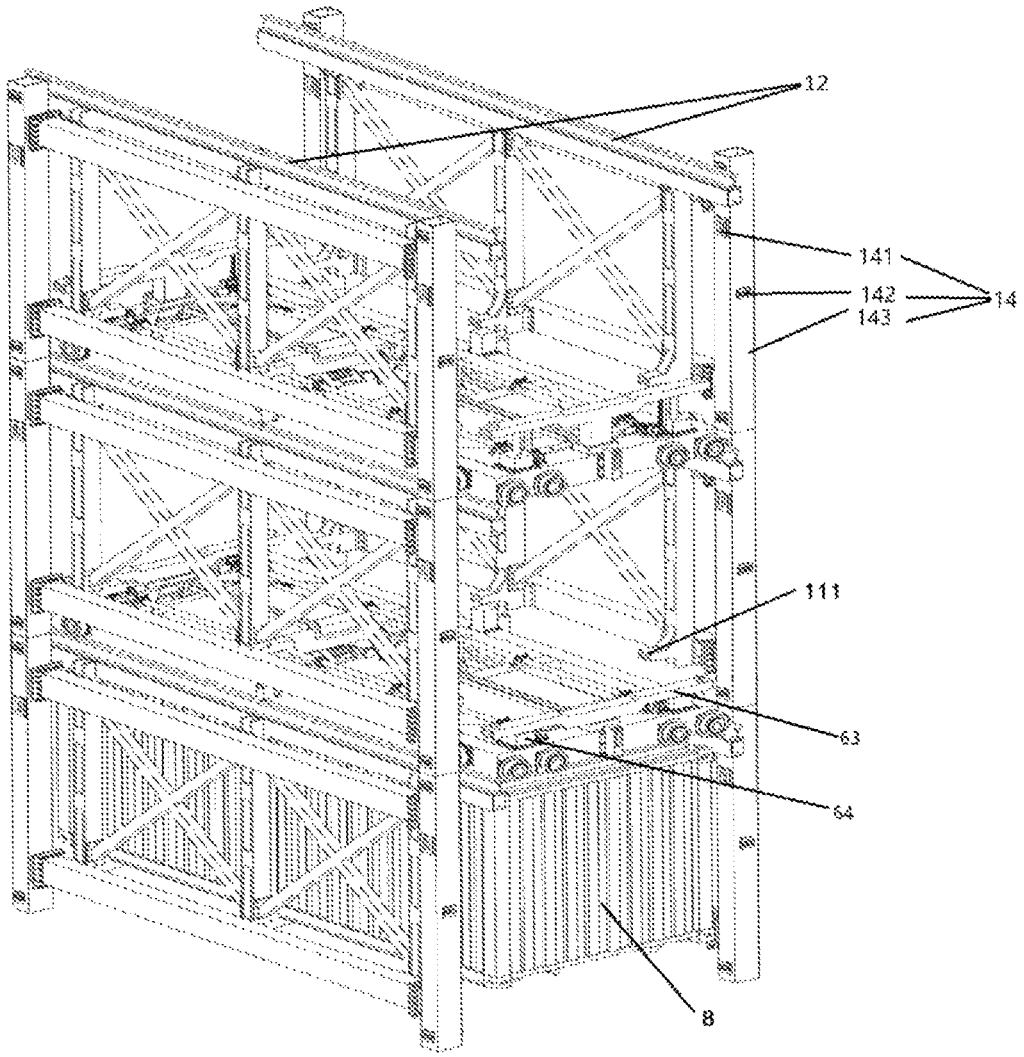
FIG. 39 shows a structural diagram of storage shelves in a same vertical direction in the sixth implementation manner.

(4) As shown in FIG. 39, the first supporting component 111 on each storage shelf group is distributed at four corners and middle positions of the storage shelf group and is used for supporting the containers.

Figure 40:
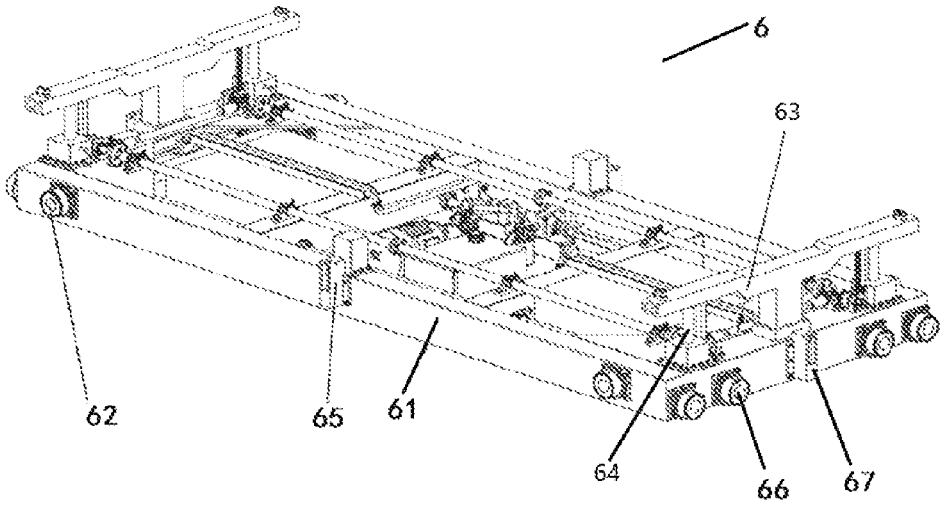
FIG. 40 shows a structural diagram of a self-delivering trolley in the sixth implementation manner.

(5) As shown in FIG. 39 and FIG. 40, each self-delivering trolley 6 also comprises third running wheels 66 and seventh calibrating and positioning devices 67; the third running wheels 66 and first running wheels 62 are not arranged on the same side; the third running wheels 66 is capable of running on longitudinal rails 921; and the seventh calibrating and positioning devices 67 are used for calibrating and positioning the self-delivering trolley to run longitudinally to the center of a corresponding storage warehouse through the longitudinal transfer rails 921. Four convex points are arranged on a second supporting component 63 of the self-delivering trolley 6 and are matched with four positioning notches of the container.

(6) The storage warehouse system also comprises criss-crossed transfer rail systems 92 and second transverse rails 91 which are arranged horizontally; quay cranes 10 can be directly connected with the storage warehouse system through the second transverse rails 91 and the criss-crossed transfer rail systems 92; and the self-delivering trolley 6 is capable of running into different shafts 3 through the second transverse rails 91 and the criss-crossed transfer rail systems 92.

Figure 36:
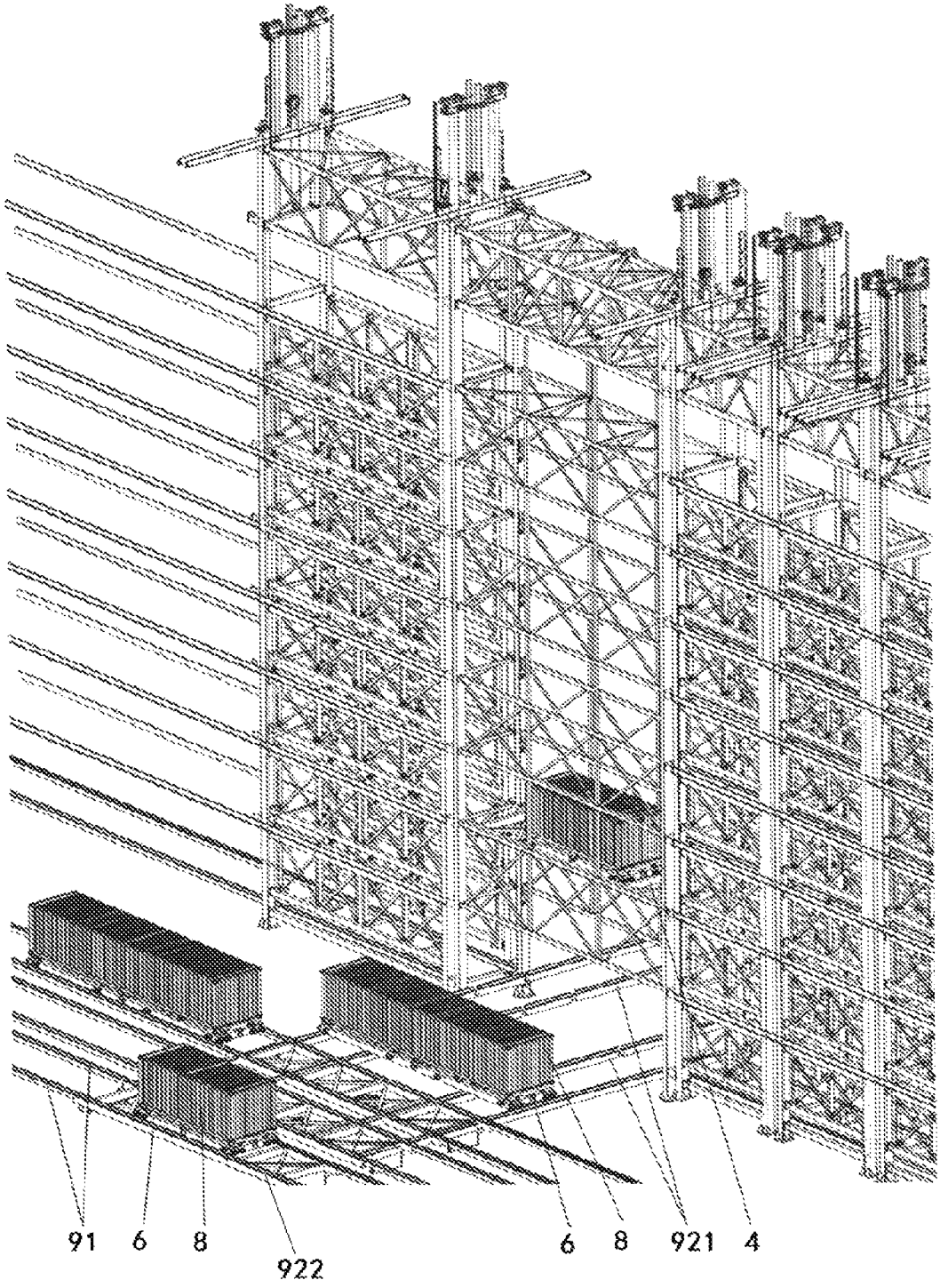
FIG. 36 shows a connection relationship diagram of criss-crossed transfer rail systems and a shaft in the sixth implementation manner.
Figure 37:
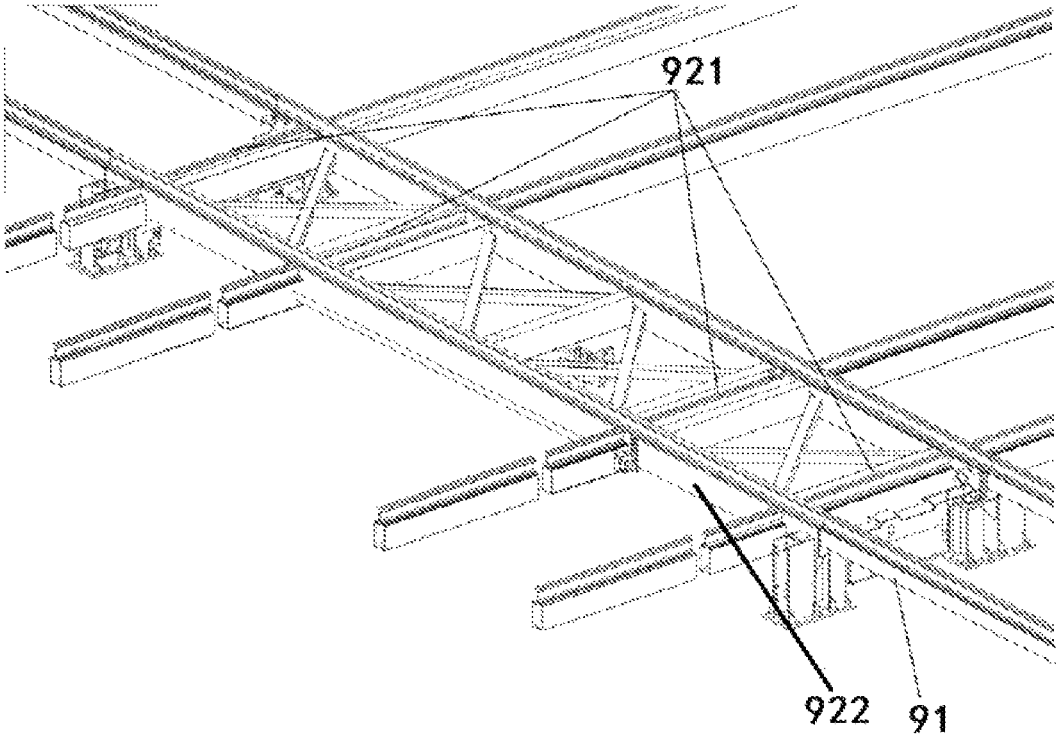
FIG. 37 shows a position relationship diagram of longitudinal rails and first transverse rails (the first transverse rails ascend)
Figure 38:
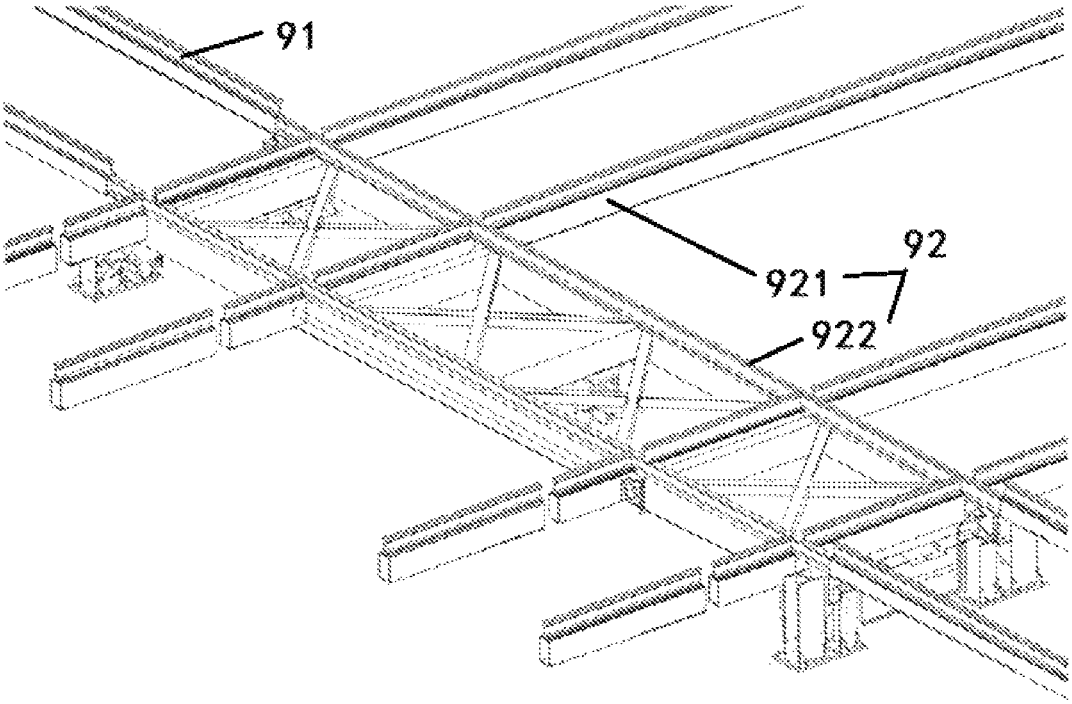
FIG. 38 shows a position relationship diagram of the longitudinal rails and the first transverse rails (the first transverse rails descend)

As shown in FIGS. 36-38, the second transverse rails 91 are connected with a plurality of criss-crossed transfer rail systems 92, and the second transverse rails 91 are parallel to first rail 12. Each criss-crossed transfer rail system 92 comprises longitudinal rails 921 and first transverse rails 922 that are vertically intersected; the first transverse rails 922 are parallel to the second transverse rails 91 and can move up and down along the vertical direction; and the longitudinal rails 921 are lower than the second transverse rails 91. When the first transverse rails 922 move upwards, the first transverse rails 922 are connected with the second transverse rails 91; and when the first transverse rails 922 move downwards, the first transverse rails 922 are lower than the longitudinal rails 921. The longitudinal rails 921 are disconnected at the junctions of the longitudinal rails 921 and the first transverse rails 922. The longitudinal rails 921 are also vertically intersected with a supporting mechanism 4, and the longitudinal rails 921 are disconnected at the junctions of the longitudinal rails 921 and the supporting mechanism 4. The supporting mechanism 4 can move downwards to be lower than the longitudinal rails 921. A self-delivering trolley 6 can be configured to switch guide rails 41 of the supporting mechanism 4 and the longitudinal rails 921 through up-and-down movement of the supporting mechanism 4 and can also be configured to switch the first transverse rails 922 and the longitudinal rails 921 through up-and-down movement of the first transverse rails 922. First running wheels 62 of the self-delivering trolley 6 is capable of running on the first transverse rails 922 and the second transverse rails 91, and third running wheels 63 is capable of running on the longitudinal rails 921. Eighth calibrating and positioning devices corresponding to third calibrating and positioning devices 65 are arranged on the transverse rails 922, and ninth calibrating and positioning devices corresponding to seventh calibrating and positioning devices 67 are arranged on the longitudinal rails 921.

(7) The storage warehouse system also comprises container loading and unloading vehicle devices 96; and the container loading and unloading vehicle devices 96 are connected with the longitudinal rails 921 and are used for transporting goods 8 in the storage warehouse system onto a container transportation vehicle or transporting the goods 8 on the container transportation vehicle into the storage warehouse system.

Figure 35:
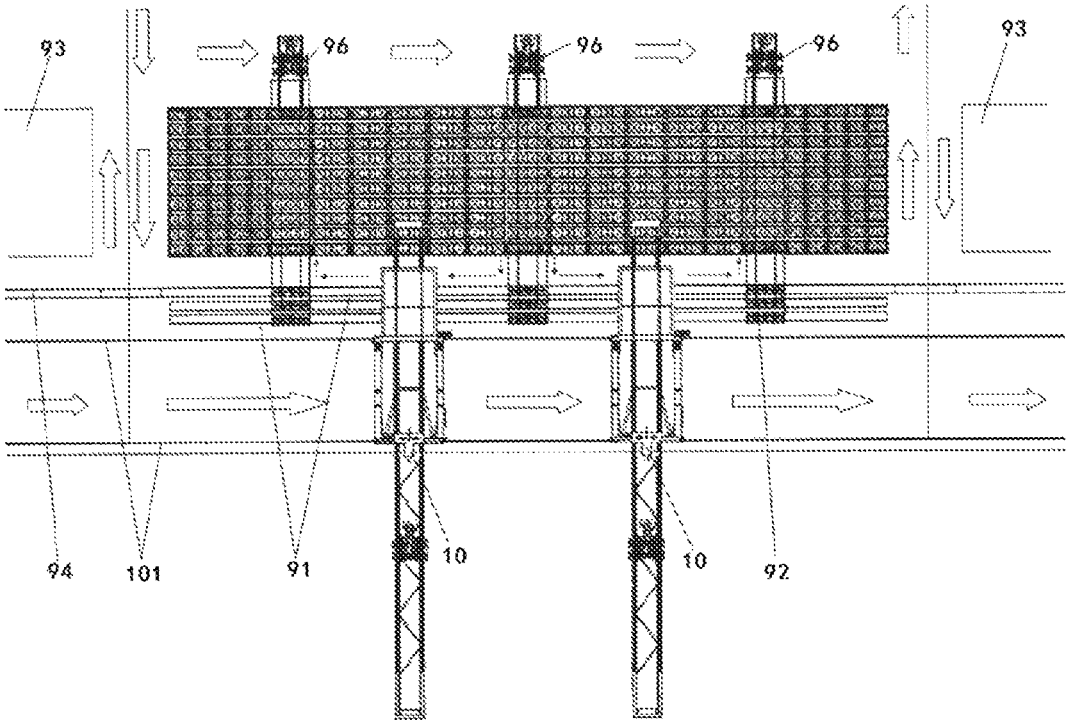
FIG. 35 shows a top view of the port wharf in the sixth implementation manner.

The process of unloading a ship (goods 8 which are directly picked up by a terminal customer and do not need to enter the storage warehouse system are directly hoisted onto the container transportation vehicle waiting under the quay crane 10 through the quay crane 10 and are directly transported, and the container transportation vehicle is capable of running along hollow arrows in FIG. 35) is that:

(1) The quay crane 10 moves to the corresponding position of the ship through quay crane movable rails 101 and is used for hoisting the goods 8 from the ship and putting the goods 8 on the self-delivering trolley 6 on the second transverse rails 91.

(2) The self-delivering trolley 6 runs from the second transverse rails 91 to the first transverse rails 922, and at the moment, the first transverse rails 922 ascend to be at the same height with the second transverse rails 91.

(3) The self-delivering trolley 6 stops on the first transverse rails 922 and is calibrated and positioned by the third calibrating and positioning devices 65 and the seventh calibrating and positioning devices.

(4) The first transverse rails 922 move downwards to be lower than the longitudinal rails 921; the self-delivering trolley 6 is switched onto the longitudinal rails 921; the self-delivering trolley 6 is driven to run from the longitudinal rails 921 to the position above the supporting mechanism 4 by the third running wheels 66; and at the moment, the supporting mechanism 4 is lower than the longitudinal rails 921.

(5) The supporting mechanism 4 moves upwards, and the self-delivering trolley 6 is switched onto the guide rails 41.

(6) The supporting mechanism 4 continues to move upwards to a designated storage layer 1, and the goods 8 are transported into designated storage shelves 11 by the self-delivering trolley 6 after forcible indirect precise leveling.

(7) When the goods 8 need to be transported out of a port, the goods 8 are picked up by the self-delivering trolley 6 and are transported to the container loading and unloading vehicle device 96 through the longitudinal rails 921.

The process of loading the ship is opposite to the process of unloading the ship.

The self-delivering trolley 6 can be switched into the shaft 3 through a path of solid arrows in FIG. 35; and inter-warehouse transfer rails 94 are used for enabling the self-delivering trolley 6 to be shared between adjacent storage warehouses 93, or the goods 8 can be transferred to container storage and pick-up warehouses 93 through the inter-warehouse transfer rails 94. In FIG. 35, hollow arrows, each of which is between every two container loading and unloading vehicle devices 96, represent a transportation path for transporting the goods 8 in the storage warehouse system to the container loading and unloading vehicle devices 96.

The above descriptions are only preferred embodiments of the present disclosure and are not used for limiting the present disclosure, and for those skilled in the art, the present disclosure can have various modifications and changes. Any modification, equivalent replacement, improvement and the like made within the spirit and principle of the present disclosure shall be included in the protection scope of the present disclosure.

I claim:

1. A single-row multilayer storage warehouse system with vertical avoidance, comprising a plurality of storage layers (1), a plurality of storage shelf lifting apparatus (2), shafts (3) arranged at both ends and/or in a middle of the storage warehouse system, a plurality of supporting mechanisms (4), a supporting mechanism lifting apparatus (5*a* or 5*b*) and a plurality of self-delivering trolleys (6);

each storage layer (1) is provided with a plurality of storage shelf groups that are arranged side by side; each storage shelf (11) comprises a first supporting component (111) for storage of goods (8), a first rail (12) for running of the self-delivering trolleys (6) and a guide post (14) for enabling the storage shelf to move vertically; the storage shelves (11) are rigid bodies; the storage shelves (11) are symmetrically arranged to form the storage shelf groups; the first supporting component (111) is arranged at a lower part of each of the storage shelves (11); the first rail (12) are arranged at a top of each of the storage shelves (11), except the storage shelf (11) on an uppermost layer; a fourth fixed rail (13) is arranged at a lower part of the storage layer (1) on a lowermost layer; the self-delivering trolleys (6) is capable of running on the first rail or the fourth fixed rail (13); each storage shelf group is in a cuboid structure; each storage shelf group corresponds to four guide posts (14), and the four guide posts (14) are respectively and vertically fixed on four vertical edges of the storage shelf group; a length of each guide post (14) is equal to a height of each storage layer (1); the storage shelves are directly stacked one by one from bottom to top; and the storage shelf lifting apparatus (2) are configured to enable the storage shelf groups to move up and down along a vertical direction;

the supporting mechanism lifting apparatus is configured to enable the supporting mechanisms (4) to move up and down in the shafts (3) and enable the supporting mechanisms (4) to stay on each storage layer (1); and when the supporting mechanisms stay on the storage layer (1), the self-delivering trolleys (6) on a same layer are capable of running onto the supporting mechanisms (4) from the first rail (12) through a third supplementary rail (28) on a first joining beam (27) or a fifth supplementary rail (30) on a second joining beam (29) and of moving up and down along with the supporting mechanisms (4);

each self-delivering trolley (6) comprises a main frame (61), first running wheels (62) located on both sides of the main frame, a second supporting component (63) arranged above the main frame and a goods lifting mechanism (64) for enabling the second supporting component (63) to move up and down; the goods lifting mechanism (64) is capable of lifting the second supporting component (63) to a highest point which is located above the first supporting component (111) of the storage shelves (11), and of lowering the second supporting component (63) to a lowest point which located below the first supporting component (111) of the storage shelves (11); and when the self-delivering trolley (6) is located right under the storage shelves (11), a position of the second supporting component (63) is staggered with a position of the first supporting component (111).

2. The system according to claim 1, wherein a guide rail (41) which is parallel to the first rail (12) is arranged above each supporting mechanism (4), so that when the supporting mechanism (4) stays on each storage layer (1), the guide rail (41) is connected with the first rail (12) or the fourth fixed rail (13) on a same layer to form a continuous rail by the third supplementary rail (28) arranged on the first joining beam (27) or the fifth supplementary rail (30) arranged on the second joining beam (29); the self-delivering trolley (6) is capable of running between the guide rail (41) and the first rail (12) or the fourth fixed rail (13) on the same layer; and the first joining beam (27) and the second joining beam (29)

are horizontally arranged between two first steel upright columns (21) of the storage shelf lifting apparatus (2).

3. The system according to claim 1, further comprising a forcible indirect precise leveling sub-system, wherein the forcible indirect precise leveling sub-system comprises a forcible leveling device (42), a forcible leveling jacket (425), an adjusting device (426) and a forcible leveling female seat (31);

the forcible leveling device (42) is horizontally arranged on side surfaces of each supporting mechanism (4); the forcible leveling device (42) comprises two first telescopic tongues (421), two first synchronous racks (422), a first synchronous gear (423) and a first push rod (424) which is telescopic in a horizontal direction; the first telescopic tongues (421) are fixed at both ends of the first push rod (424) and are capable of stretching out and drawing back along with the first push rod (424); one end of each first synchronous rack (422) is fixedly connected with one of the first telescopic tongues (421), and another end of the first synchronous rack is meshed with the first synchronous gear (423);

the forcible leveling jacket (425) is rigidly connected with each supporting mechanism (4); the forcible leveling device (42) is sleeved in the forcible leveling device jacket (425); the adjusting device (426) is arranged at a bottom of the forcible leveling jacket (425) and comprises a supporting spring and an adjusting bolt;

the forcible leveling female seat (31) is arranged on each layer of the shafts (3); the forcible leveling female seat is internally provided with a position sensor corresponding to the first telescopic tongues (421); and a trumpet opening for receiving the first telescopic tongues (421) is formed in the forcible leveling female seat (31).

4. The system according to claim 1, wherein each storage shelf lifting apparatus (2) is configured to drive the storage shelves (11) on all the storage layers (1) in a same vertical direction to move up and down; each storage shelf lifting apparatus (2) comprises four first steel upright columns (21), four lifting rods (23) and a first power mechanism (24);

the first steel upright columns (21) are arranged vertically; and a guide groove (211) is formed in each first steel upright column (21), so that the four guide posts (14) respectively slide up and down in four guide grooves (211) of the four first steel upright columns (21);

the guide posts (14) are in a hollow structure; each lifting rod (23) vertically penetrates through interiors of all the guide posts (14) on a same first steel upright column (21); an upper part of each lifting rod (23) is connected with the first power mechanism (24); a lower part of each lifting rod comprises a plurality of lifting hook sections (231); and each lifting hook section (231) corresponds to one guide post (14);

lifting bayonets (141) are symmetrically formed in side surfaces of each guide post (14); each lifting hook section (231) is provided with lifting hooks at positions corresponding to the lifting bayonets (141); the lifting hooks is capable of stretching outwards or being opened to couple with the lifting bayonets (141); and the lifting hooks is also capable of drawing back inwards.

5. The system according to claim 4, wherein each lifting hook is in a V-shaped structure and comprises two hook arms (2311), a first pin (2312) which is fixed and is used for connecting the two hook arms, and a torsional spring (2313) arranged at a connecting position of the two hook arms;

each lifting hook section (231) comprises a telescopic sleeve (2314) and a third push rod (2315); the third push rod (2315) is fixedly connected with the telescopic sleeve (2314) and is telescopic in the vertical direction; the telescopic sleeve (2314) is in a hollow tubular structure; the connecting position of the two hook arms (2311) is arranged at an upper part of the telescopic sleeve (2314); and the telescopic sleeve (2314) is capable of moving up and down along with the third push rod (2315), and the two hook arms (2311) are sleeved in or released out of the telescopic sleeve (2314).

6. The system according to claim 4, wherein each storage shelf lifting apparatus (2) also comprises a synchronization mechanism (25); the synchronization mechanism comprises a plurality of second synchronous racks (251) fixed vertically at upper parts of the lifting rods, two longitudinal synchronous shafts (252) arranged horizontally, a plurality of second synchronous gears (253) arranged at both ends of the longitudinal synchronous shafts, a plurality of third synchronous gears (254) arranged in a middle of the longitudinal synchronous shafts, a transverse synchronous shaft (255) arranged horizontally and a plurality of fourth synchronous gears (256) arranged at both ends of the transverse synchronous shaft; both ends of each longitudinal synchronous shaft (252) are meshed with the second synchronous racks (251) by the second synchronous gears (253); the transverse synchronous shaft (255) is perpendicular to the longitudinal synchronous shafts (252); and the third synchronous gears (254) are meshed with the fourth synchronous gears (256).

7. The system according to claim 4, wherein each storage shelf lifting apparatus (2) also comprises a fall prevention mechanism (26); the fall prevention mechanism (26) comprises a fall prevention non-return rack (261) fixed vertically at an upper part of each lifting rod (23) and a decompression fall-prevention device (262) fixed on each first steel upright column; the decompression fall-prevention device (262) comprises a non-return tongue (2621), a direction current (DC) coil body (2622) and a torsional spring (2623); one end of the non-return tongue (2621) is articulated with a magnet core body of the DC coil body (2622), and the other end of the non-return tongue is vertically hinged with a third pin (2625) and the torsional spring (2623); and the non-return tongue (2621) is capable of rotating along an axial direction of the torsional spring (2623), so that the non-return tongue (2621) is clamped with or is separated from the fall prevention non-return rack (261).

8. The system according to claim 1, wherein a number of the shafts (3) is two, and the two shafts are respectively arranged at both ends of the storage warehouse system;

the supporting mechanism lifting apparatus (**5*a*) comprises a plurality of vertical racks (5*a*-1), a plurality of vertical guide rails (5*a*-2), a plurality of trolley conductors (5*a*-3), a plurality of movement gears (5*a*-4) meshed with the vertical racks, a first motor (5*a*-5), a plurality of guide shoes (5*a*-6), a plurality of electricity collection clips (5*a*-7), a plurality of fourth push rods (5*a*-8) which are telescopic and arranged horizontally, and a plurality of third synchronous racks (5*a*-9**);

each shaft (3) comprises a second steel upright column (36) for supporting the supporting mechanisms (4) to move up and down, and the vertical racks (**5*a*-1), the vertical guide rails (5*a*-2) and the trolley conductors (5*a*-3) are all vertically fixed on the second steel upright columns (36) of the shaft (3**);

the movement gears (5*a*-4), the first motor (5*a*-5), the guide shoes (5*a*-6), the electricity collection clips (5*a*-7), the fourth push rods (5*a*-8) and the third synchronous racks (5*a*-9) are all arranged on the supporting mechanisms (4);

the first motor (5*a*-5) is used for providing power of rotation for the movement gears (5*a*-4) and driving the supporting mechanisms (4) to move up and down; the guide shoes (5*a*-6) are fixed at both ends of each fourth push rod (5*a*-8); the guide shoes (5*a*-6) are matched with the vertical guide rails (5*a*-2) when the guide shoes stretch out along with the fourth push rod (5*a*-8), so that the supporting mechanisms (4) move up and down along the vertical guide rails (5*a*-2); the electricity collection clips (5*a*-7) are also fixed at both ends of the fourth push rod (5*a*-8), and the electricity collection clips (5*a*-7) are in touch with the trolley conductors (5*a*-3) to obtain electricity when the electricity collection clips stretch out along with the fourth push rod (5*a*-8); and the third synchronous racks (5*a*-9) are used for enabling the guide shoes (5*a*-2) and the electricity collection clips (5*a*-7) to be telescopic synchronously.

9. The system according to claim 8, wherein each supporting mechanism (4) also comprises a plurality of second running wheels (43) arranged on both sides of the supporting mechanism;

the storage warehouse system also comprises two supporting mechanism horizontal movement layers (7); the two supporting mechanism horizontal movement layers (7) are respectively located on an uppermost layer and a lowermost layer of the storage warehouse system; a second rail (71) for horizontal movement of the supporting mechanism is arranged on the supporting mechanism horizontal movement layer (7) on the uppermost layer; and a third rail (73) for horizontal movement of the supporting mechanism is arranged on the supporting mechanism horizontal movement layer (7) on the lowermost layer;

an uppermost layer of each shaft (3) is provided with a first supplementary rail (32) and a fifth push rod (33), and the fifth push rod is arranged horizontally and is telescopic; the fifth push rod (33) is vertically connected with the first supplementary rail (32); the first supplementary rail (32) is parallel to the second rail (71) on the uppermost layer and is capable of being connected with or separated from the second rail (71) on the uppermost layer along with horizontal movement of the fifth push rod (33); and when the first supplementary rail (32) is connected with the second rail (71) on the uppermost layer, the supporting mechanism (4) is capable of running from the first supplementary rail (32) onto the second rail (71);

the third rail (73) extends to a lowermost layer of the shaft (3), so that the supporting mechanism (4) is capable of running on the third rail (73).

10. The system according to claim 9, wherein a horizontal gear guide plate (72) is arranged on each supporting mechanism horizontal movement layer (7); and the gear guide plate is identical to the vertical racks (5*a*-1) in tooth shape and is in alignment with the vertical racks (5*a*-1), so that the movement gears (5*a*-4) are capable of horizontally sliding on the gear guide plate (72).

11. The system according to claim 1, wherein the supporting mechanism lifting apparatus (5*b*) comprises four chains (5*b*-1), two double-row lifting chain wheels (5*b*-2), a second motor (5*b*-3), two bend chain wheels (5*b*-5) and a weight (5*b*-4); the second motor (5*b*-3) is connected with the double-row lifting chain wheels (5*b*-2) and is used for driving the double-row lifting chain wheels (5*b*-2) to rotate; the chains (5*b*-1) are arranged on the double-row lifting chain wheels (5*b*-2) and move up and down along with rotation of the double-row lifting chain wheels (5*b*-2); two of the chains pass through the bend chain wheels (5*b*-5); one end of each chain (5*b*-1) is connected with the weight (5*b*-4), and the other end of the chain is connected with the supporting mechanisms (4).

* * * * *